US011751003B1

(12) United States Patent
Brimijoin, II et al.

(10) Patent No.: US 11,751,003 B1
(45) **Date of Patent: *Sep. 5, 2023**

(54) PERSONALIZATION OF HEAD-RELATED TRANSFER FUNCTION

(71) Applicant: META PLATFORMS TECHNOLOGIES, LLC, Menlo Park, CA (US)

(72) Inventors: William Owen Brimijoin, II, Kirkland, WA (US); Tomasz Rudzki, York (GB); Sebastià Vicenç Amegnual Gari, Seattle, WA (US); Michaela Warnecke, Somerville, MA (US); Andrew Francl, Redmond, WA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/498,554

(22) Filed: Oct. 11, 2021

Related U.S. Application Data

(60) Provisional application No. 63/158,606, filed on Mar. 9, 2021.

(51) Int. Cl.
*H04S 7/00* (2006.01)

(52) U.S. Cl.
CPC ..... *H04S 7/40* (2013.01); *H04S 7/303* (2013.01); *H04S 2420/01* (2013.01)

(58) Field of Classification Search
None
See application file for complete search history.

(56) References Cited

U.S. PATENT DOCUMENTS

| | | | | |
|---|---|---|---|---|
| 10,028,070 | B1 * | 7/2018 | Gamper | H04S 7/302 |
| 10,397,724 | B2 | 8/2019 | Celestinos et al. | |
| 10,999,690 | B2 | 5/2021 | Ithapu et al. | |
| 2013/0041648 | A1 * | 2/2013 | Osman | H04S 7/302 381/300 |
| 2017/0045941 | A1 * | 2/2017 | Tokubo | A63F 13/53 |
| 2018/0035226 | A1 * | 2/2018 | Reijniers | H04R 29/001 |
| 2020/0275232 | A1 * | 8/2020 | Villanueva-Barreiro | H04S 1/002 |
| 2021/0400414 | A1 | 12/2021 | Tu et al. | |
| 2022/0225050 | A1 * | 7/2022 | Ninan | G06F 3/011 |

* cited by examiner

*Primary Examiner* — Qin Zhu
(74) *Attorney, Agent, or Firm* — Fenwick & West LLP

(57) ABSTRACT

Embodiments relate to personalization of a head-related transfer function (HRTF) for a given user. A sound source is spatialized for an initial position using an initial version of a HRTF to obtain an initial spatialized sound source. Upon presentation of the initial spatialized sound source, at least one property of the HRTF is adjusted in an iterative manner based on at least one perceptive response from the user to generate a version of the HRTF customized for the user. Each perceptive response from the user indicates a respective offset between a perceived position and a target position of the sound source. The customized version of the HRTF is applied to one or more audio channels to form spatialized audio content for the perceived position. The spatialized audio content is presented to the user, wherein the offset between the perceived position and the target position is reduced.

18 Claims, 10 Drawing Sheets

PERSONALIZATION OF HEAD-RELATED TRANSFER FUNCTION

CROSS REFERENCE TO RELATED APPLICATIONS

This application claims a priority and benefit to U.S. Provisional Patent Application Ser. No. 63/158,606, filed Mar. 9, 2021, which is hereby incorporated by reference in its entirety.

FIELD OF THE INVENTION

The present disclosure relates generally to spatialization of audio content, and specifically relates to personalization of a head-related transfer function (HRTF) to a particular user for spatialization of audio content for presentation to that particular user.

BACKGROUND

Audio systems can utilize one or more head-related transfer functions (HRTFs) to spatialize audio content for presentation to a listener (e.g., user of a headset with an embedded audio system). However, the HRTFs are typically represented as impulse responses that are not specifically tailored for a specific listener (user). Thus, there is a need to accurately and efficiently customize (i.e., personalize) the one or more HRTFs for the specific listener in order to improve the listener's audio experience.

SUMMARY

Embodiments of the present disclosure support a method, computer readable storage medium, and an audio system for customization (i.e., personalization) of a HRTF to a given user. A sound source is spatialized for an initial position in a local area using an initial (i.e., generic or non-individualized) version of a HRTF to obtain an initial spatialized sound source. Upon presenting the initial spatialized sound source to the user, at least one property of the HRTF is adjusted in an iterative manner based on at least one perceptive response from the user to generate a version of the HRTF customized for the user. During the iterative process of customization of the HRTF, each perceptive response from the user indicates a respective offset between a perceived position and a target position of the sound source upon presentation of at least one spatialized version of the sound source. Each perceptive response from the user may further indicate a change in an apparent coloration (e.g., spectral profile, equalization, etc.) of a sound originating from the sound source. After the process of customization of the HRTF is finished, the customized version of the HRTF is applied to one or more audio channels to form spatialized audio content for the perceived position of the sound source. Then, the spatialized audio content is presented to the user, wherein the offset between the perceived position and the target position is reduced. Furthermore, the apparent coloration of the spatialized audio content presented to the user may be also reduced, e.g., below a threshold level.

Figure 1A:
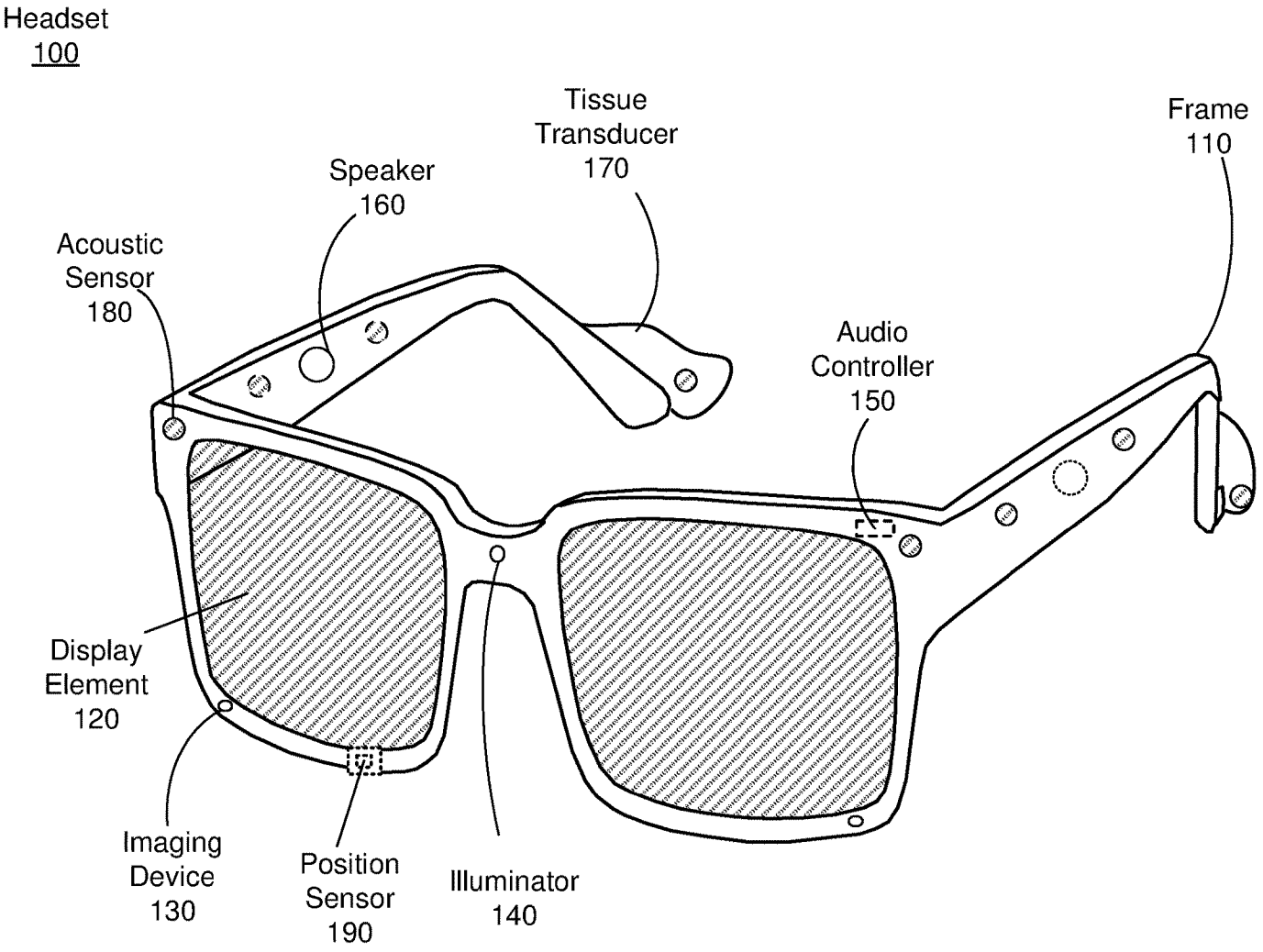
FIG. 1A is a perspective view of a headset implemented as an eyewear device, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Embodiments of the present disclosure relate to a method for personalization (i.e., customization) of one or more HRTFs for a given user of an audio system. The one or more personalized HRTFs are used to generate spatialized audio content presented to a listener. At least a portion of means used for performing the methods presented herein for personalization of the HRTFs is an audio renderer. The audio renderer is described in detail in U.S. patent application Ser. No. 17/379,730, filed Jul. 19, 2021, which is hereby incorporated by reference in its entirety.

The audio renderer may be part of the audio system, whereas the audio system may be integrated into a headset worn by the user (i.e., listener of the audio system). The audio renderer represents an efficient means for personalization of a HRTF to spatialize audio to be tailor-made for the user. Because the audio renderer utilizes infinite impulse response (IIR) filters, one or more HRTFs can be warped, scaled, and adjusted by the user in real time. For example, modifying a time-domain impulse response of a filter to achieve a desired change in the frequency domain, e.g. changing the center frequency of the filter is typically a complex task. However, by utilizing a parametric framework of the audio renderer composed of multiple IIR filters, arbitrary changes to the overall frequency response of the audio system can be achieved by modifying the center frequency, gain, and quality (Q) factor of the corresponding filters in the audio renderer. The audio renderer provides enough flexibility for efficient personalization of one or more HRTFs, as well as for adjusting and correcting the one or more HRTFs while targeting individual device equalization and/or hardware output frequency response curves.

The functionality unlocked by the audio renderer is that any user can adjust their own HRTF in real time, hearing the results of applied adjustments instantaneously, thus allowing each user to correct for any elevation and/or azimuth errors in relation to a perceived position of a sound source. Embodiments of the present disclosure relate to methods for manual adjustment of a HRTF by utilizing, e.g., the audio renderer, which allows rendering of spatial audio specifically for a given user. Details about the audio renderer pertinent to the presented methods for personalization of a HRTF are described in connection with FIG. 3 and FIG. 4.

Embodiments of the present disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to create content in an artificial reality and/or are otherwise used in an artificial reality. The artificial reality system that provides the artificial reality content may be implemented on various platforms, including a wearable device (e.g., headset) connected to a host computer system, a standalone wearable device (e.g., headset), a mobile device or computing system, or any other hardware platform capable of providing artificial reality content to one or more viewers.

FIG. 1A is a perspective view of a headset 100 implemented as an eyewear device, in accordance with one or more embodiments. In some embodiments, the eyewear device is a near eye display (NED). In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame, and may include, among other components, a display assembly including one or more display elements 120, a depth camera assembly (DCA), an audio system, and a position sensor 190. While FIG. 1A illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1A.

The frame 110 holds the other components of the headset 100. The frame 110 includes a front part that holds the one or more display elements 120 and end pieces (e.g., temples) to attach to a head of the user. The front part of the frame 110 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 120 provide light to a user wearing the headset 100. As illustrated in FIG. 1A, the headset includes a display element 120 for each eye of a user. In some embodiments, a display element 120 generates image light that is provided to an eye box of the headset 100. The eye box is a location in space that an eye of the user occupies while wearing the headset 100. For example, a display element 120 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eye box of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 120 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 120 are at least partially transparent, such that light from the local area may be combined with light from the one or more display elements to produce AR and/or MR content.

In some embodiments, a display element 120 does not generate image light, and instead is a lens that transmits light from the local area to the eye box. For example, one or both of the display elements 120 may be a lens without correction (non-prescription) or a prescription lens (e.g., single vision, bifocal and trifocal, or progressive) to help correct for defects in a user's eyesight. In some embodiments, the display element 120 may be polarized and/or tinted to protect the user's eyes from the sun.

In some embodiments, the display element 120 may include an additional optics block (not shown). The optics block may include one or more optical elements (e.g., lens, Fresnel lens, etc.) that direct light from the display element 120 to the eye box. The optics block may, e.g., correct for aberrations in some or all of the image content, magnify some or all of the image, or some combination thereof.

The DCA determines depth information for a portion of a local area surrounding the headset 100. The DCA includes one or more imaging devices 130 and a DCA controller (not shown in FIG. 1A), and may also include an illuminator 140. In some embodiments, the illuminator 140 illuminates a portion of the local area with light. The light may be, e.g., structured light (e.g., dot pattern, bars, etc.) in the infrared (IR), IR flash for time-of-flight, etc. In some embodiments, the one or more imaging devices 130 capture images of the portion of the local area that include the light from the illuminator 140. As illustrated, FIG. 1A shows a single illuminator 140 and two imaging devices 130. In alternate embodiments, there is no illuminator 140 and at least two imaging devices 130.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 140), some other technique to determine depth of a scene, or some combination thereof.

The audio system provides audio content. The audio system includes a transducer array, a sensor array, and an audio controller 150. However, in other embodiments, the audio system may include different and/or additional components. Similarly, in some cases, functionality described with reference to the components of the audio system can be distributed among the components in a different manner than is described here. For example, some or all of the functions of the audio controller 150 may be performed by a remote server.

The transducer array presents sound to user. The transducer array includes a plurality of transducers. A transducer may be a speaker 160 or a tissue transducer 170 (e.g., a bone conduction transducer or a cartilage conduction transducer). Although the speakers 160 are shown exterior to the frame 110, the speakers 160 may be enclosed in the frame 110. The tissue transducer 170 couples to the head of the user and directly vibrates tissue (e.g., bone or cartilage) of the user to generate sound. In accordance with embodiments of the present disclosure, the transducer array comprises two transducers (e.g., two speakers 160, two tissue transducers 170, or one speaker 160 and one tissue transducer 170), i.e., one transducer for each ear. The locations of transducers may be different from what is shown in FIG. 1A.

The sensor array detects sounds within the local area of the headset 100. The sensor array includes a plurality of acoustic sensors 180. An acoustic sensor 180 captures sounds emitted from one or more sound sources in the local area (e.g., a room). Each acoustic sensor is configured to detect sound and convert the detected sound into an electronic format (analog or digital). The acoustic sensors 180 may be acoustic wave sensors, microphones, sound transducers, or similar sensors that are suitable for detecting sounds.

In some embodiments, one or more acoustic sensors 180 may be placed in an ear canal of each ear (e.g., acting as binaural microphones). In some embodiments, the acoustic sensors 180 may be placed on an exterior surface of the headset 100, placed on an interior surface of the headset 100, separate from the headset 100 (e.g., part of some other device), or some combination thereof. The number and/or locations of acoustic sensors 180 may be different from what is shown in FIG. 1A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 100.

The audio controller 150 processes information from the sensor array that describes sounds detected by the sensor array. The audio controller 150 may comprise a processor and a non-transitory computer-readable storage medium. The audio controller 150 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 160, or some combination thereof.

In accordance with embodiments of the present disclosure, the audio controller 150 performs one or more processing steps in relation to personalization (customization) of a HRTF for a given user of the audio system. In some embodiments, the audio controller 150 comprises a plurality of modules some of which are part of the audio renderer. The audio controller 150 may spatialize a sound source for an initial position of the sound source in a local area using an initial version of the HRTF to obtain an initial spatialized sound source. Upon presenting the initial spatialized sound source to the user (e.g., via the speakers 160 and/or the tissue transducers 170), the audio controller 150 may adjust, in an iterative manner based on at least one perceptive response from the user, at least one property of the HRTF to generate a version of the HRTF customized for the user. A perceptive response from the user represents a feedback from the user about a location of the sound source as perceived by the user when corresponding spatialized sound from the sound source is presented to the user via the audio system. The perceptive user's response may further include an indication about a change in an apparent coloration (e.g., spectral profile, equalization, etc.) of a sound originating from the sound source. The perceptive user's response can be provided to the audio system via an input mechanism of the audio renderer or via an interface device (e.g., a smartphone) coupled to the audio system.

Each perceptive response provided from the user during the iterative customization process may indicate a respective offset between a perceived position of the sound source and a target position of the sound source upon presentation of a corresponding spatialized version of the sound source (e.g., via the speakers 160 and/or the tissue transducers 170). The target position of the sound source represents a position in the local area where the spatialized sound is intended to originate from, whereas the perceived position of the sound source represents a position in the local area where the spatialized sound ends up (i.e., is perceived to be located by the user). The iterative HRTF customization process reduces the offset between the target position and the perceived position by iteratively spatializing the sound such that the newly presented sound is spatialized ideally at the target position. Once the iterative HRTF customization process is finished (e.g., the user becomes satisfied with the presented spatialized version of the sound source), the audio controller 150 may apply the customized version of the HRTF to one or more audio channels to form spatialized audio content for the perceived position of the sound source. The audio controller 150 may also save (e.g., at an internal memory of the controller 150) the customized version of the HRTF for further application to the one or more audio channels. The audio system may present the generated spatialized audio content to the user (e.g., via the speakers 160 and/or the tissue transducers 170), wherein the offset between the perceived position of the sound source and the target position of the sound source is reduced. In one or more embodiments, the apparent coloration of the spatialized audio content presented to the user is also reduced, e.g., below a threshold level.

In some embodiments, the audio system is fully integrated into the headset 100. In some other embodiments, the audio system is distributed among multiple devices, such as between a computing device (e.g., smart phone or a console) and the headset 100. The computing device may be interfaced (e.g., via a wired or wireless connection) with the headset 100. In such cases, some of the processing steps presented herein may be performed at a portion of the audio system integrated into the computing device. For example, one or more functions of the audio controller 150 may be implemented at the computing device. More details about the structure and operations of the audio system are described in connection with FIG. 2, FIG. 3 and FIG. 7.

The position sensor 190 generates one or more measurement signals in response to motion of the headset 100. The position sensor 190 may be located on a portion of the frame 110 of the headset 100. The position sensor 190 may include an inertial measurement unit (IMU). Examples of position sensor 190 include: one or more accelerometers, one or more gyroscopes, one or more magnetometers, another suitable type of sensor that detects motion, a type of sensor used for error correction of the IMU, or some combination thereof. The position sensor 190 may be located external to the IMU, internal to the IMU, or some combination thereof.

The audio system can use positional information describing the headset 100 (e.g., from the position sensor 190) to update virtual positions of sound sources so that the sound sources are positionally locked relative to the headset 100. In this case, when the user wearing the headset 100 turns their head, virtual positions of the virtual sources move with the head. Alternatively, virtual positions of the virtual sources are not locked relative to an orientation of the headset 100. In this case, when the user wearing the headset 100 turns their head, apparent virtual positions of the sound sources would not change.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more RGB cameras that capture images of some or all of the local area. In some embodiments, some or all of the imaging devices 130 of the DCA may also function as the PCA. The images captured by the PCA and the depth information determined by the DCA may be used to determine parameters of the local area, generate a model of the local area, update a model of the local area, or some combination thereof. Furthermore, the position sensor 190 tracks the position (e.g., location and pose) of the headset 100 within the room. Additional details regarding the components of the headset 100 are discussed below in connection with FIG. 2, FIG. 3 and FIG. 7.

Figure 1B:
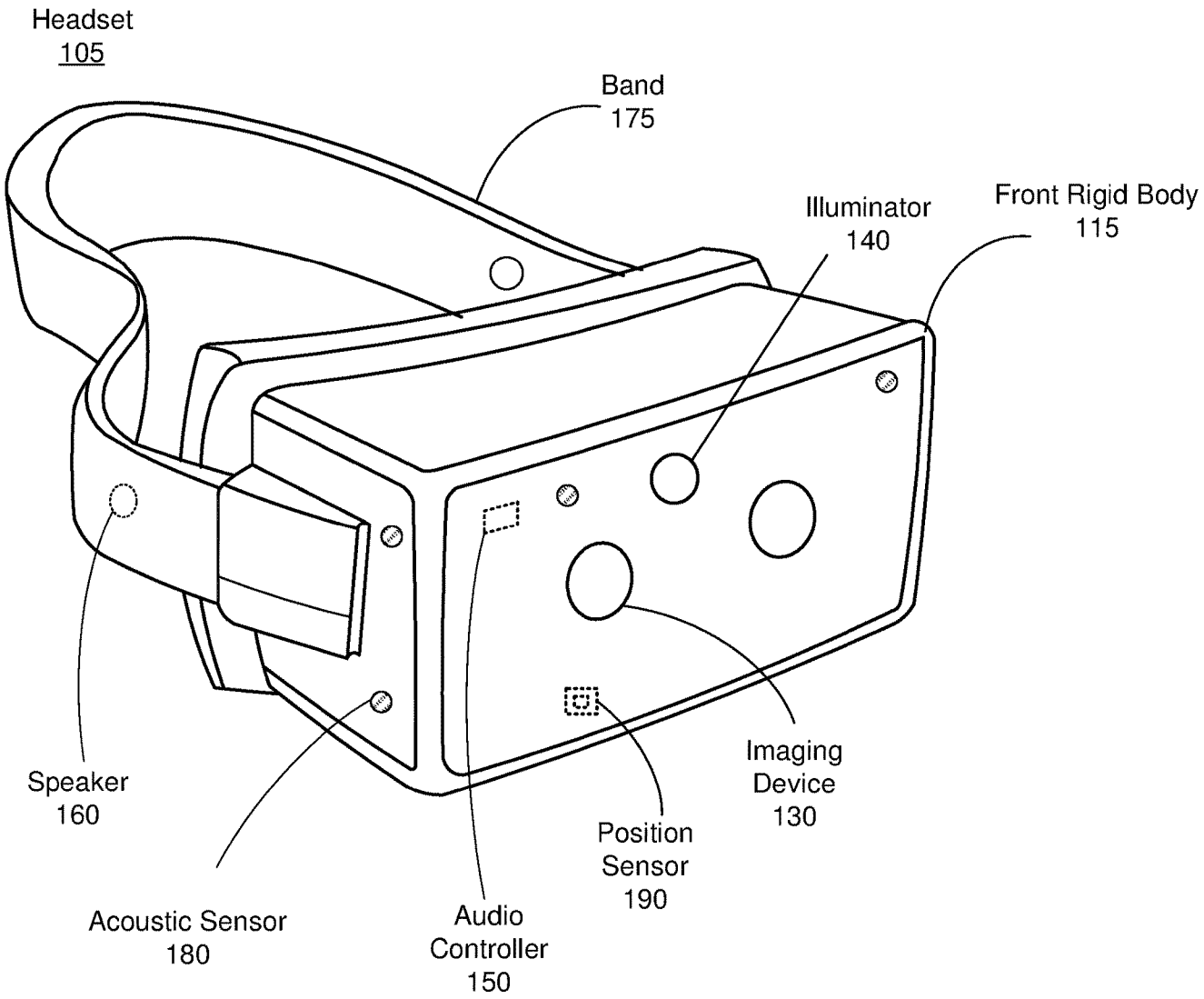
FIG. 1B is a perspective view of a headset implemented as a head-mounted display, in accordance with one or more embodiments.

FIG. 1B is a perspective view of a headset 105 implemented as a HMD, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 115 and a band 175. The headset 105 includes many of the same components described above with reference to FIG. 1A, but modified to integrate with the HMD form factor. For example, the HMD includes a display assembly, a DCA, an audio system, and a position sensor 190. FIG. 1B shows the illuminator 140, a plurality of the speakers 160, a plurality of the imaging devices 130, a plurality of acoustic sensors 180, and the position sensor 190. The speakers 160 may be located in various locations, such as coupled to the band 175 (as shown), coupled to the front rigid body 115, or may be configured to be inserted within the ear canal of a user.

Figure 2:
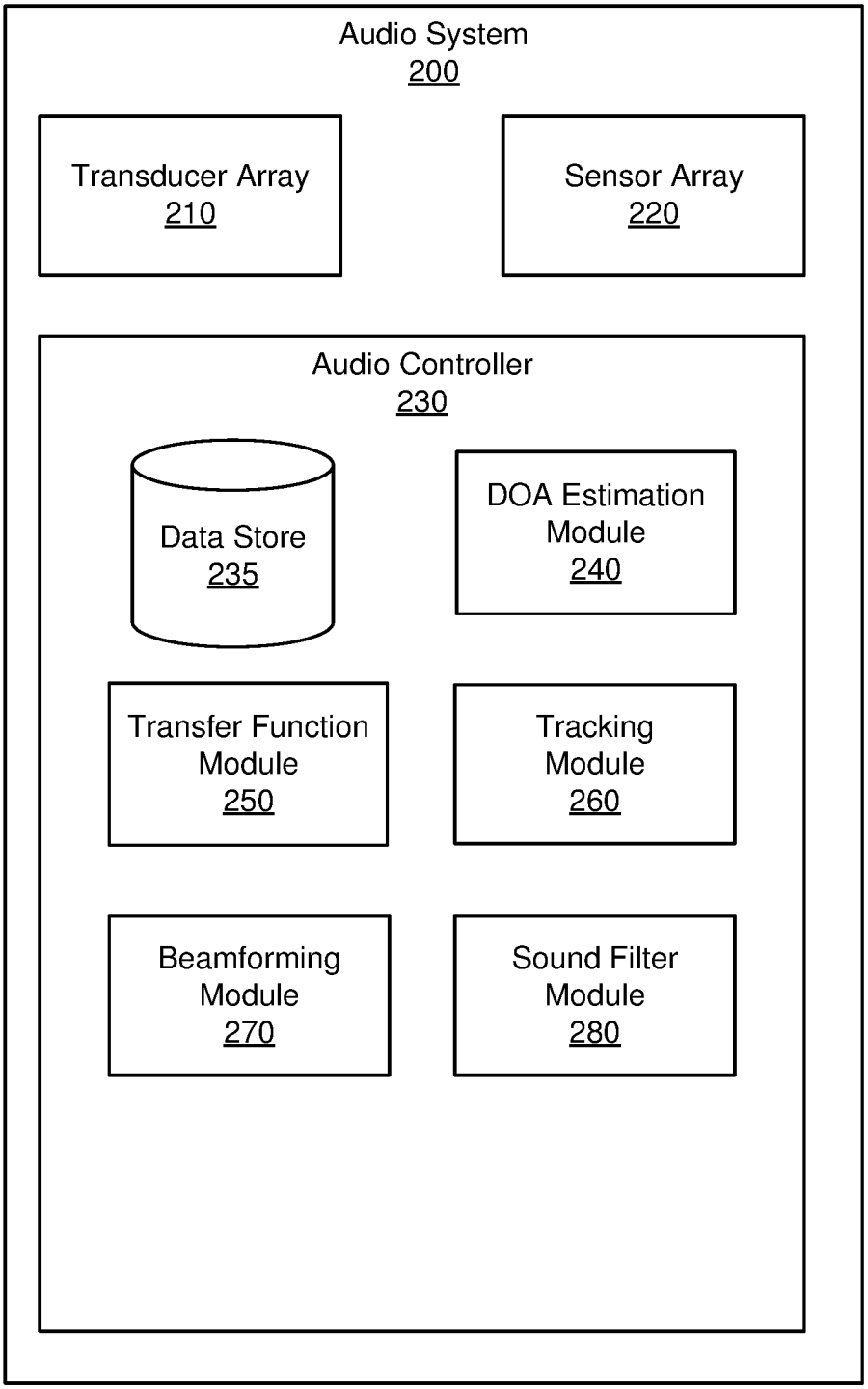
FIG. 2 is a block diagram of an audio system, in accordance with one or more embodiments.

FIG. 2 is a block diagram of an audio system 200, in accordance with one or more embodiments. The audio system in FIG. 1A or FIG. 1B may be an embodiment of the audio system 200. The audio system 200 generates one or more acoustic transfer functions for a user. The audio system 200 may then use the one or more acoustic transfer functions to generate audio content for the user. In the embodiment of FIG. 2, the audio system 200 includes a transducer array 210, a sensor array 220, and an audio controller 230. Some embodiments of the audio system 200 have different components than those described here. Similarly, in some cases, functions can be distributed among the components in a different manner than is described here.

The transducer array 210 is configured to present audio content. The transducer array 210 includes a pair of transducers, i.e., one transducer for each ear. A transducer is a device that provides audio content. A transducer may be, e.g., a speaker (e.g., the speaker 160), a tissue transducer (e.g., the tissue transducer 170), some other device that provides audio content, or some combination thereof. A tissue transducer may be configured to function as a bone conduction transducer or a cartilage conduction transducer. The transducer array 210 may present audio content via air conduction (e.g., via one or two speakers), via bone conduction (via one or two bone conduction transducer), via cartilage conduction audio system (via one or two cartilage conduction transducers), or some combination thereof.

The bone conduction transducers generate acoustic pressure waves by vibrating bone/tissue in the user's head. A bone conduction transducer may be coupled to a portion of a headset, and may be configured to be behind the auricle coupled to a portion of the user's skull. The bone conduction transducer receives vibration instructions from the audio controller 230, and vibrates a portion of the user's skull based on the received instructions. The vibrations from the bone conduction transducer generate a tissue-borne acoustic pressure wave that propagates toward the user's cochlea, bypassing the eardrum.

The cartilage conduction transducers generate acoustic pressure waves by vibrating one or more portions of the auricular cartilage of the ears of the user. A cartilage conduction transducer may be coupled to a portion of a headset, and may be configured to be coupled to one or more portions of the auricular cartilage of the ear. For example, the cartilage conduction transducer may couple to the back of an auricle of the ear of the user. The cartilage conduction transducer may be located anywhere along the auricular cartilage around the outer ear (e.g., the pinna, the tragus, some other portion of the auricular cartilage, or some combination thereof). Vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. The generated airborne acoustic pressure waves propagate down the ear canal toward the ear drum.

The transducer array 210 generates audio content in accordance with instructions from the audio controller 230. In some embodiments, the audio content is spatialized. Spatialized audio content is audio content that appears to originate from a particular direction and/or target region (e.g., an object in the local area and/or a virtual object). For example, spatialized audio content can make it appear that sound is originating from a virtual singer across a room from a user of the audio system 200. The transducer array 210 may be coupled to a wearable device (e.g., the headset 100 or the headset 105). In alternate embodiments, the transducer array 210 may be a pair of speakers that are separate from the wearable device (e.g., coupled to an external console).

The sensor array 220 detects sounds within a local area surrounding the sensor array 220. The sensor array 220 may include a plurality of acoustic sensors that each detect air pressure variations of a sound wave and convert the detected sounds into an electronic format (analog or digital). The plurality of acoustic sensors may be positioned on a headset (e.g., headset 100 and/or the headset 105), on a user (e.g., in an ear canal of the user), on a neckband, or some combination thereof. An acoustic sensor may be, e.g., a microphone, a vibration sensor, an accelerometer, or any combination thereof. In some embodiments, the sensor array 220 is configured to monitor the audio content generated by the transducer array 210 using at least some of the plurality of acoustic sensors. Increasing the number of sensors may improve the accuracy of information (e.g., directionality) describing a sound field produced by the transducer array 210 and/or sound from the local area.

The audio controller 230 controls operation of the audio system 200. In the embodiment of FIG. 2, the audio controller 230 includes a data store 235, a DOA estimation module 240, a transfer function module 250, a tracking module 260, a beamforming module 270, and a sound filter module 280. The audio controller 230 may be located inside a headset, in some embodiments. Some embodiments of the audio controller 230 have different components than those described here. Similarly, functions can be distributed among the components in different manners than described here. For example, some functions of the audio controller 230 may be performed external to the headset. The user may opt in to allow the audio controller 230 to transmit data captured by the headset to systems external to the headset, and the user may select privacy settings controlling access to any such data.

In accordance with embodiments of the present disclosure, the audio controller 230 performs one or more processing steps in relation to personalization (customization) of a HRTF for a given user of the audio system 200. The audio controller 230 may spatialize a sound source for an initial position of the sound source in a local area using an initial version of the HRTF to obtain an initial spatialized sound source. Upon presenting the initial spatialized sound source to the user (e.g., via the transducer array 210), the audio controller 230 may adjust, in an iterative manner based on at least one perceptive response from the user, at least one property of the HRTF to generate a version of the HRTF customized for the user. Each perceptive response provided from the user during the iterative customization process may indicate a respective offset between a perceived position of the sound source and a target position of the sound source upon presentation of a corresponding spatialized version of the sound source (e.g., via the transducer array 210). Once the iterative customization process is finished (e.g., the user becomes satisfied with the presented spatialized version of the sound source), the audio controller 230 may apply the customized version of the HRTF to one or more audio channels to form spatialized audio content for the perceived position of the sound source. The audio system 200 may present the generated spatialized audio content to the user (e.g., via the transducer array 210), wherein the offset between the perceived position of the sound source and the target position of the sound source is reduced. In some embodiments, the user may be capable of pointing to an actual position (i.e., a target position or intended position) of a sound source. In such cases, the audio system 200 may re-map (e.g., via the audio controller 230) the perceived position to the actual position of the sound source. The audio controller 150 of the headset 100 in FIG. 1A or the audio controller 150 of the headset 105 in FIG. 1B may be an embodiment of the audio controller 230.

The data store 235 stores data for use by the audio system 200. Data in the data store 235 may include sounds recorded in the local area of the audio system 200, audio content, HRTFs, transfer functions for one or more sensors, array transfer functions (ATFs) for one or more of the acoustic sensors, sound source locations, virtual model of local area, direction of arrival estimates, sound filters, virtual positions of sound sources, multi-source audio signals, signals for transducers (e.g., speakers) for each ear, and other data relevant for use by the audio system 200, or any combination thereof. The data store 235 may be implemented as a non-transitory computer-readable storage medium.

The data store 235 also stores data in association with the operation of the sound filter modules associated with the selection and application of the audio renderer. The stored data may include static filter parameter values, one dimensional and two dimensional interpolating look-up tables for looking up frequency/gain/Q triplet filter parameter values for a given azimuth and/or elevation target sound source angles. The data store 235 may also store single channel audio signals for processing at the audio renderer and presentation to a user at the headset as spatialized audio content through multiple channels. In some embodiments, the data store 235 may store default values for input parameters such as target fidelity of the audio content rendering in the form of target frequency response values, target signal to noise ratios, target power consumption by a selected audio renderer, target compute requirements of a selected audio renderer, and target memory footprint of a selected audio renderer. The data store 235 may store values such as a desired spectral profile and equalization for the generated spatialized audio content from the audio renderer. In some embodiments, the data store 235 may store a selection model for use in selecting an audio renderer based on input parameter values. The stored selection model may be in the form of a look-up table that maps ranges of input parameter values to one of the audio renderers. In some embodiments, the stored selection model may be in the form of specific weighted combinations of the input parameter values that are mapped to one of the audio renderers. In some embodiments, the data store 235 may store data for use by, e.g., a parametric filter fitting system. The stored data may include a set of measured HRTFs associated with context vectors spatial location of a sound source, such as azimuth and elevation values, as well as anthropometric features of one or more users. The data store 235 may also store updated audio filter parameter values as determined by the parametric filter fitting system.

The user may opt-in to allow the data store 235 to record data captured by the audio system 200. In some embodiments, the audio system 200 may employ always on recording, in which the audio system 200 records all sounds captured by the audio system 200 in order to improve the experience for the user. The user may opt in or opt out to allow or prevent the audio system 200 from recording, storing, or transmitting the recorded data to other entities.

The DOA estimation module 240 is configured to localize sound sources in the local area based in part on information from the sensor array 220. Localization is a process of determining where sound sources are located relative to the user of the audio system 200. The DOA estimation module 240 performs a DOA analysis to localize one or more sound sources within the local area. The DOA analysis may include analyzing the intensity, spectra, and/or arrival time of each sound at the sensor array 220 to determine the direction from which the sounds originated. In some cases, the DOA analysis may include any suitable algorithm for analyzing a surrounding acoustic environment in which the audio system 200 is located.

For example, the DOA analysis may be designed to receive input signals from the sensor array 220 and apply digital signal processing algorithms to the input signals to estimate a direction of arrival. These algorithms may include, for example, delay and sum algorithms where the input signal is sampled, and the resulting weighted and delayed versions of the sampled signal are averaged together to determine a DOA. A least mean squared (LMS) algorithm may also be implemented to create an adaptive filter. This adaptive filter may then be used to identify differences in signal intensity, for example, or differences in time of arrival. These differences may then be used to estimate the DOA. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct path audio signal. Those bins having a portion of the direct-path signal may then be analyzed to identify the angle at which the sensor array 220 received the direct-path audio signal. The determined angle may then be used to identify the DOA for the received input signal. Other algorithms not listed above may also be used alone or in combination with the above algorithms to determine DOA.

In some embodiments, the DOA estimation module 240 may also determine the DOA with respect to an absolute position of the audio system 200 within the local area. The position of the sensor array 220 may be received from an external system (e.g., some other component of a headset, an artificial reality console, a mapping server, a position sensor (e.g., the position sensor 190), etc.). The external system may create a virtual model of the local area, in which the local area and the position of the audio system 200 are mapped. The received position information may include a location and/or an orientation of some or all of the audio system 200 (e.g., of the sensor array 220). The DOA estimation module 240 may update the estimated DOA based on the received position information.

The transfer function module 250 is configured to generate one or more acoustic transfer functions. Generally, a transfer function is a mathematical function giving a corresponding output value for each possible input value. Based on parameters of the detected sounds, the transfer function module 250 generates one or more acoustic transfer functions associated with the audio system. The acoustic transfer functions may be ATFs, HRTFs, other types of acoustic transfer functions, or some combination thereof. An ATF characterizes how the microphone receives a sound from a point in space.

An ATF includes a number of transfer functions that characterize a relationship between the sound source and the corresponding sound received by the acoustic sensors in the sensor array 220. Accordingly, for a sound source there is a corresponding transfer function for each of the acoustic sensors in the sensor array 220. And collectively the set of transfer functions is referred to as an ATF. Accordingly, for each sound source there is a corresponding ATF. Note that the sound source may be, e.g., someone or something generating sound in the local area, the user, or one or more transducers of the transducer array 210. The ATF for a particular sound source location relative to the sensor array 220 may differ from user to user due to a person's anatomy (e.g., ear shape, shoulders, etc.) that affects the sound as it travels to the person's ears. Accordingly, the ATFs of the sensor array 220 are personalized for each user of the audio system 200.

In some embodiments, the transfer function module 250 determines one or more HRTFs for a user of the audio system 200. The HRTF characterizes how the anatomy (e.g., shapes) of the user's body, head and/or ear filters the sound arriving at an eardrum from a point in space. The HRTF for a particular source location relative to a person is unique to each ear of the person (and is unique to the person) due to the person's anatomy (e.g., ear shape, shoulders, etc.) that affects the sound as it travels to the person's ears. In some embodiments, the transfer function module 250 may determine HRTFs for the user using a calibration process. In some embodiments, the transfer function module 250 may provide information about the user to a remote system. The user may adjust privacy settings to allow or prevent the transfer function module 250 from providing the information about the user to any remote systems. The remote system determines a set of HRTFs that are customized to the user using, e.g., machine learning, and provides the customized set of HRTFs to the audio system 200.

The tracking module 260 is configured to track locations of one or more sound sources. The tracking module 260 may compare current DOA estimates and compare them with a stored history of previous DOA estimates. In some embodiments, the audio system 200 may recalculate DOA estimates on a periodic schedule, such as once per second, or once per millisecond. The tracking module may compare the current DOA estimates with previous DOA estimates, and in response to a change in a DOA estimate for a sound source, the tracking module 260 may determine that the sound source moved. In some embodiments, the tracking module 260 may detect a change in location based on visual information received from the headset or some other external source. The tracking module 260 may track the movement of one or more sound sources over time. The tracking module 260 may store values for a number of sound sources and a location of each sound source at each point in time. In response to a change in a value of the number or locations of the sound sources, the tracking module 260 may determine that a sound source moved. The tracking module 260 may calculate an estimate of the localization variance. The localization variance may be used as a confidence level for each determination of a change in movement.

The beamforming module 270 is configured to process one or more ATFs to selectively emphasize sounds from sound sources within a certain area while de-emphasizing sounds from other areas. In analyzing sounds detected by the sensor array 220, the beamforming module 270 may combine information from different acoustic sensors to emphasize sound associated from a particular region of the local area while deemphasizing sound that is from outside of the region. The beamforming module 270 may isolate an audio signal associated with sound from a particular sound source from other sound sources in the local area based on, e.g., different DOA estimates from the DOA estimation module 240 and the tracking module 260. The beamforming module 270 may thus selectively analyze discrete sound sources in the local area. In some embodiments, the beamforming module 270 may enhance a signal from a sound source. For example, the beamforming module 270 may apply sound filters which eliminate signals above, below, or between certain frequencies. Signal enhancement acts to enhance sounds associated with a given identified sound source relative to other sounds detected by the sensor array 220.

The sound filter module 280 determines sound filters for the transducer array 210. In some embodiments, the sound filters cause the audio content to be spatialized, such that the audio content appears to originate from a target position in the local area. The sound filter module 280 may use one or more HRTFs and/or acoustic parameters to generate the sound filters. The acoustic parameters describe acoustic properties of the local area. The acoustic parameters may include, e.g., a reverberation time, a reverberation level, a room impulse response, etc. In some embodiments, the sound filter module 280 calculates one or more of the acoustic parameters. In some embodiments, the sound filter module 280 requests the acoustic parameters from a mapping server (e.g., as described below in conjunction with FIG. 7).

The sound filter module 280 provides the sound filters to the transducer array 210. In some embodiments, the sound filters may cause positive or negative amplification of sounds as a function of frequency. In some embodiments, audio content presented by the transducer array 210 is multi-channel spatialized audio. Spatialized audio content is audio content that appears to originate from a particular direction and/or target region (e.g., an object in the local area and/or a virtual object). For example, spatialized audio content can make it appear that sound is originating from a virtual singer across a room from a user of the audio system 200.

Figure 3:
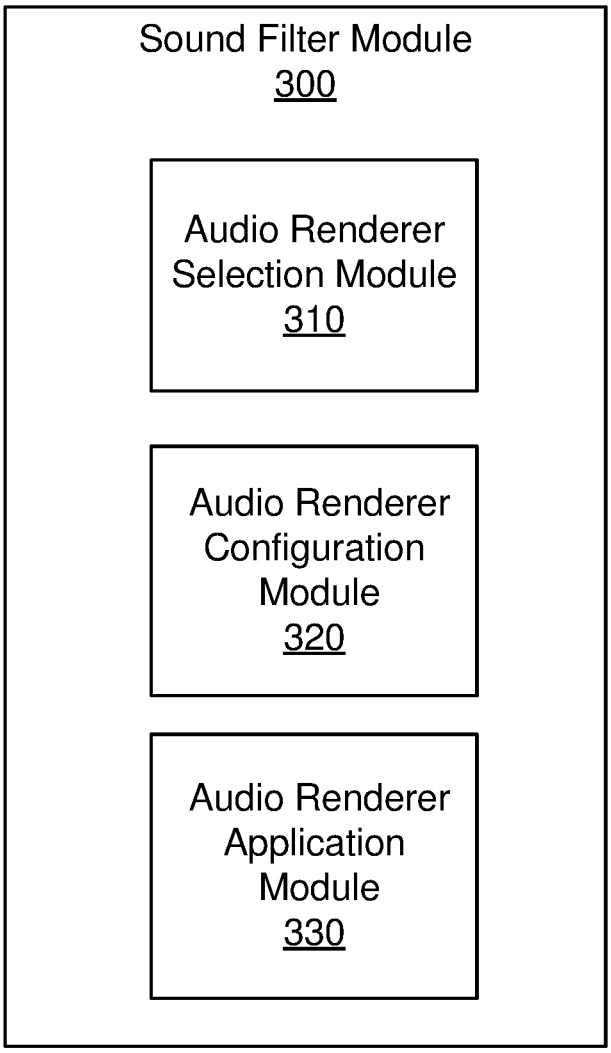
FIG. 3 is a block diagram of the components of a sound filter module, in accordance with one or more embodiments.

FIG. 3 is a block diagram of the components of a sound filter module, in accordance with one or more embodiments. The sound filter module 300 is an embodiment of the sound filter module 280 depicted in FIG. 2. The sound filter module 300 includes an audio renderer selection module 310, an audio renderer configuration module 320, and an audio renderer application module 330. In alternative configurations, the sound filter module 300 may include different and/or additional modules. Similarly, functions can be distributed among the modules in different manners than described here.

The audio renderer selection module 310 selects an audio renderer from a set of possible audio renderers for generating multiple channel spatialized audio content from a single channel input audio signal. The set of possible audio renderers may include a range of audio renderers, from audio renderers with few configured filters to audio renderers with several configured filters. Audio renderers with few filters may have lower power consumption, lower compute load, and/or lower memory footprint requirements when compared to audio renderers with increasing numbers of cascaded static and dynamic filters that have correspondingly increasing power consumption, compute load, and/or memory footprint requirements. As the number of static and dynamic audio filters increase in an audio renderer, there is a corresponding improvement in its accuracy in approximating a magnitude spectrum of a given HRTF. For example, an audio renderer with several configured dynamic binaural filters may be capable of being close to approximating a full given HRTF (i.e., to within a decibel or so across the full audible range). Thus, there is a trade-off in the audio renderer selection module 310 selecting an audio renderer with additional filters since such an audio renderer will lead to a corresponding increase in power consumption, compute load, and memory requirements, while providing an improved approximation of a given HRTF when used in generating spatialized audio content.

In some embodiments, the set of possible audio renderers includes three audio renderers that provide different levels of accuracy in approximating the magnitude spectrum of a given HRTF. In these embodiments, the set includes: (i) an audio renderer that provides a first approximation of a given HRTF using two biquad filters and a delay, along with one-dimensional interpolating look-up tables for configuring the filters, (ii) a second audio renderer that provides a second approximation of the given HRTF using six biquad filters, two gain adjust filters, and one-dimensional and two-dimensional interpolating look-up tables for configuring the filters, and (iii) a third audio renderer that provides a third approximation of the given HRTF using twelve biquad filters, and one-dimensional and two-dimensional interpolating look-up tables for configuring the filters. In these embodiments, as the number of filters in the selected audio renderer increases, the corresponding approximation of a given HRTF is closer to the full magnitude of the given HRTF, i.e., the third approximation of the given HRTF is more accurate than the second approximation, which is more accurate than the first approximation of the given HRTF. Furthermore, each of the audio renderers in the set of audio renderers may be associated with a particular range of memory footprint, compute load, power consumption etc. In alternative embodiments, the audio renderers in the set may have different numbers of static and dynamic filters, including more or less than a pair of binaural biquad filters, etc. In some embodiments, the filters in an audio renderer may be coupled in a different manner than described here.

The selection of the particular audio renderer from the set of possible audio renderers by the audio renderer selection module 310 is based on certain input parameters. In some embodiments, the input parameters may include a target power consumption, target compute requirements, target memory footprint, and a target level of accuracy in approximating a given HRTF, etc. The input parameters also specify a target fidelity of the audio content rendering as a target frequency response, a target signal to noise ratio, etc., for the rendered audio content. In some embodiments, a weighted combination of the received input parameters may be used in selecting the audio renderer. In some embodiments, the audio renderer selection module 310 may obtain default values for these parameters from the data store 235 and use the default values in selecting the audio renderer. Given input parameters (e.g., a target memory footprint and a target compute load), the audio renderer selection module 310 may select a particular audio renderer from the set of possible audio renderers using a selection model retrieved from the data store 235. The selection model may be in the form of a look-up table that maps ranges of input parameter values to one of the audio renderers in the set of possible audio renderers. In some embodiments, the selection model may map specific weighted combinations of the input parameter values to one of the audio renderers. Other selection models may also be possible. In some embodiments, the audio renderer selection module 310 may receive input parameters in the form of a specification of a target level of accuracy in approximating a given HRTF. In these embodiments, the audio renderer selection module 310 may select an audio renderer from the set of audio renderers based on a model. The model may be in the form of, for example, a look-up table, that maps specific audio renderers in the set to achieving particular levels of accuracy in approximating a given HRTF. In such embodiments, the target level of accuracy of approximation of the given HRTF may be specified as an input parameter using a virtual and/or physical input mechanism (e.g., dial) that may be tuned to specify the target approximation accuracy level.

The audio renderer configuration module 320 configures the various filters of a selected audio renderer to provide an approximation of a given HRTF. In some embodiments, the audio renderer configuration module 320 may retrieve one or more models from the data store 235 for use in configuring the various filters of the selected audio renderer. The audio renderer configuration module 320 receives and user input parameters such as a target sound source angle along with the retrieved models to configure the filters of the selected audio renderer. As noted previously, the input target sound source angle may be specified as an azimuth value and/or an elevation value. For example, the input target sound source angle may specify azimuth and elevation values for the location of a virtual singer performing on a virtual stage. The audio renderer configuration module 320 configures the filters so that the configured audio renderer may subsequently receive and process a single channel audio signal to generate spatialized audio content corresponding to multiple channel audio signals (e.g., left and right channel audio signals) for presentation to a user.

In embodiments described herein, the audio renderer configuration module 320 configures the selected audio renderer as a cascaded series of IIR filters and fractional or non-fractional delays to generate the spatialized audio content corresponding to multiple channel audio signals (e.g., left and right channel audio signals) from the input single channel audio signal. In some embodiments, the cascaded series of IIR filters may be biquad filters, which are 2nd-order recursive linear filters comprised of two poles and two zeros. Biquad filters used in embodiments herein include "high-shelf" and "peak/notch" filters. Parameters of these biquad filters may be specified using filter type (high-shelf vs peak/notch) and frequency/gain/Q triplet parameter values. The cascaded series of IIR filters may be one or more single channel (i.e., monaural) static filters, monaural dynamic filters, as well as multiple channel (i.e., binaural) dynamic filters.

The audio renderer configuration module 320 may configure fixed (i.e., unchanging with respect to target sound source angle) parameters of each static monaural filter in the selected audio renderer as scalar values. A static filter is configured by the audio renderer configuration module 320 to mimic those components of an HRTF that are substantially constant and independent of location relative to the user (e.g., the center frequency, gain and Q values configured for the static filter). For example, the static filters may be viewed as approximating a shape of one or more HRTFs, as well as allowing for an adjustment of the overall coloration (e.g., spectral profile, equalization, etc.) of the generated spatialized audio content. For example, a static filter may be adjusted to match the coloration of a true HRTF so that the final binaural output may feel more natural from an aesthetic standpoint to the user. Thus, the configuration of a static filter may involve adjusting parameter values of the filter (e.g., any of the center frequency, gain, and Q values) in a manner that is independent of the location of the sound source but that is aesthetically suitable for the user. The audio renderer configuration module 320 configures a static filter for application to audio signals received at a single channel. In embodiments where the selected audio renderer has a plurality of static filters, the plurality of static filters may process an incoming single channel audio signal in series, in parallel, or some combination thereof. A static filter may be, e.g., a static high shelf filter, a static notch filter, some other type of filter, or some combination thereof.

Dynamic filters in the selected audio renderer process an input audio signal to generate spatialized audio content, i.e., audio content that appears to be originating from a particular spatial location relative to the user. The dynamic filters in the selected audio renderer may be monaural dynamic filters as well as binaural dynamic filters. In contrast to a static filter, the filter parameters for a dynamic filter, both monaural and binaural, are based in part on the target location relative to the location of the user (e.g., azimuth, elevation). The monaural dynamic filters may be coupled to the monaural static filters described above (i.e., receive input audio signal and generate an output audio signal) through the single channel. The binaural dynamic filters are coupled (i.e., receive an input audio signal and generate an output audio signal) through each individual channel of multiple audio channels (such as a connected left channel and a connected right channel). The binaural dynamic filters are used to reproduce frequency-dependent interaural level differences (ILD) across the ears, including contralateral head shadow as well as pinna-shadow effects observed in the rear hemifield. Binaural filters may be, e.g., a peak filter, a high-shelf filter, etc., that are applied in series to each audio channel signal of the multiple audio channels. While a same general type of dynamic filter (e.g., peak filter) may be configured for multiple audio channel signals—the specific shape of each filter may be different. Typical HRTFs of users tend to have a first peak at around 4-6 kHz and a main notch at around 5-7 kHz. In some embodiments, the monaural dynamic audio filters are configured to produce such a main first peak (e.g., at around 4-6 kHz) and such a main notch (e.g., at around 5-7 kHz) that are found in typical HRTFs. In alternate embodiments, the binaural dynamic filters are configured to produce such a main first peak and main notch.

The audio renderer configuration module 320 retrieves one or more models from the data store 235 for configuring the selected audio renderer. The models may be look-up tables, functions, models that have been trained using machine learning techniques, etc., or some combination thereof. A retrieved model maps various values of target sound source angles to corresponding filter parameter values such as center frequency/gain/Q triplet values. In some embodiments, the model is represented as one or more look-up tables that use input azimuth and/or elevation parameter values to output linearly interpolated values for the triplet values. In some embodiments, the look-up tables may have content values with the azimuth and elevation parameter values defined in degrees (i.e., °), and as noted previously, a coordinate system defined as follows: an azimuth parameter value of 0° is defined as straight ahead relative to the user's head, negative values are to the left of the user's head, and positive values are to the right of the user's head; an elevation parameter value of 0° is defined as a level with the user's head, negative values are below the user's head, and positive values are above the user's head. In some embodiments, the model may map any of either the received azimuth or elevation parameter input values to the dynamic filter parameters through interpolating one-dimensional look-up tables. In some embodiments, the model may map both the received azimuth and elevation parameters to dynamic filter parameters through interpolating one-dimensional look-up tables. In some embodiments, the model may map both the received azimuth and elevation parameter input values to the dynamic filter parameters through interpolating two-dimensional look-up tables. However, the latter embodiments may have high memory and computational requirements.

The audio renderer configuration module 320 may configure the dynamic filters of the selected audio renderer as frequency/gain/Q triplet values using the retrieved model based on the input target source angle. The audio renderer configuration module 320 may use retrieved one-dimensional interpolating look-up tables to input either one of azimuth or elevation values from the input target sound source angle in order to obtain filter parameters such as the center frequency/gain/Q triplet values. Alternatively, the audio renderer configuration module 320 may use retrieved one-dimensional interpolating look-up tables to input both azimuth and elevation values from the input target sound source angle in order to obtain filter parameters such as the center frequency/gain/Q triplet values. Using the two-dimensional look-up tables allows for a much closer approximation of a given HRTF. However, the memory requirements of the configured renderer also increases.

The audio renderer configuration module 320 may configure a fractional delay between a left and a right audio channel. The audio renderer configuration module 320 determines an amount of delay to be applied based on the input target location using a model (such as a look-up table) retrieved from the data store 235. The configured delay may be a fractional delay or a non-fractional delay, and it mimics the delay between sound hitting different ears based on a position of a sound source relative to the user, thereby reproducing the interaural time differences (ITDs). For example, if the sound source is to the right of a user, sound from the sound source would be rendered at the right ear before being rendered at the left ear. The audio renderer configuration module 320 may determine the delays by, e.g., inputting the target location (e.g., azimuth and/or elevation) into the model (e.g., a look-up table). Since single sample differences (at a sampling frequency of 48 kHz) across the two ears of the user are detectable by human listeners when close to 0°, ideally the fractional delays need to be implemented as a subsample delay. However, for lower compute load requirements, the audio renderer configuration module 320 may round the applied delays to a nearest whole sample.

The audio renderer application module 330 applies the configured audio renderer to an audio signal received at a single channel to generate spatialized audio content for multiple audio channels (e.g., the left and right audio channels). The audio renderer application module 330 ensures that the (mono) audio signal is received at the single channel and is processed by any monaural static filters and monaural dynamic filters in the audio renderer. The (possibly processed) audio signal is subsequently split into individual signals (such as a left signal and a right signal) for subsequent processing by any binaural filters in the configured audio renderer. Finally, the audio renderer application module 330 ensures that the generated spatialized audio content at the individual channels of the multiple channels is provided to the transducer array for presentation to the user at the headset. Thus, the set of configured monaural static filters and the set of configured monaural dynamic filters are connected via a single channel for receiving and outputting a single channel audio signal. Furthermore, the set of configured binaural dynamic filters are connected via corresponding left and right channels for receiving and outputting the corresponding left and right audio signals. In some embodiments, the audio renderer application module 330 may also generate spatialized audio content for additional audio channels. The audio renderer application module 330 provides the generated spatialized audio content to the transducer array 210 for presenting the spatialized audio content to the user via the headset 100. The audio renderer application module 330 ensures that a single channel audio signal is received and processed by an audio renderer to generate left and right channel spatialized audio content in a method of scalable quality.

Figure 4:
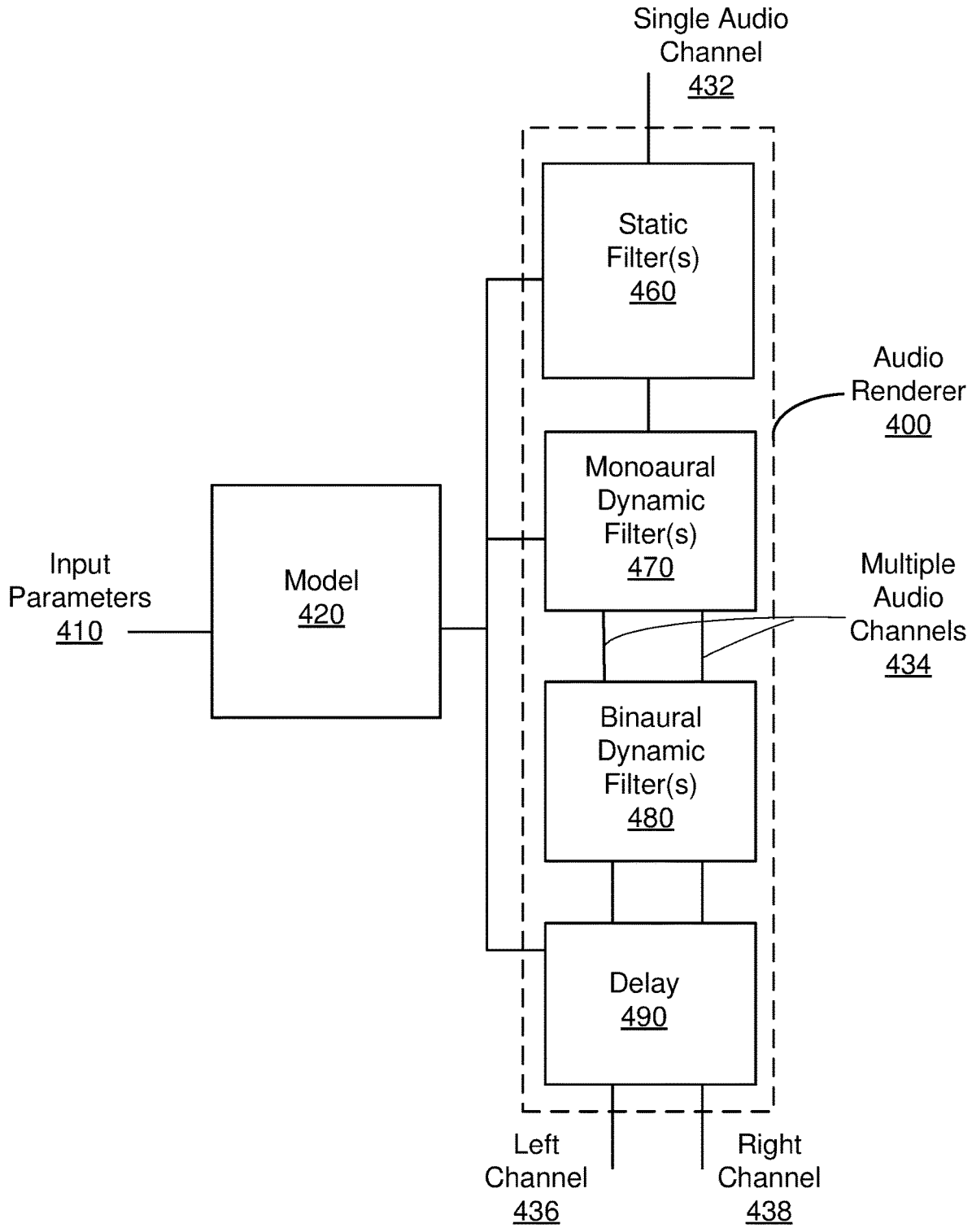
FIG. 4 is a functional depiction of an audio renderer used to process a single channel input audio signal and generate spatialized audio content for multiple channels, in accordance with one or more embodiments.

FIG. 4 is a functional depiction of an audio renderer 400 used to process a single channel input audio signal and generate spatialized audio content for multiple channels. The audio renderer 400 represents an audio renderer that has been selected and configured by the sound filter module 300. In some embodiments, there may be additional or different elements or elements in a different order than depicted herein.

In some embodiments, the input parameters 410 include the target sound source angle, including the target azimuth and target elevation values. For example, a virtual sound source may be provided 20 feet in front of the user at an elevation of 15° (such as a virtual singer on a virtual stage in front of the user).

A model 420 represents the various models, such as look-up tables, functions, etc., used to obtain filter parameter values for static filters, dynamic filters, and delay in the audio renderer 400. In some embodiments, the model 420 may be obtained from the data store 235. The model 420 may be any of the models described with respect to FIG. 3. Thus, in some embodiments, the model 420 may include one-dimensional and two-dimensional interpolating look-up tables that are used to obtain filter parameter values based on the input sound source angle values such as azimuth and/or elevation parameter values, as well as the delay values.

An audio signal is provided as input to the audio renderer 400 at a single audio channel 430 of the selected audio renderer 400. The input audio signal is processed by the audio renderer 400 is used to generate spatialized multichannel audio signals for presentation to a user via a headset.

The input audio signal at a single audio channel 432 is provided as input to one or more static filters 460. The static filters 460 may be any of the static filters described with respect to FIG. 3, such as monaural static filters. The monaural static filters 460 receive an input audio signal via the single audio channel 432 and provide processed output audio signals via the single audio channel 432. In some embodiments with more than one monaural static filter 460, the filters may be connected in series via the single audio channel 432.

An input audio signal, possibly processed by the static filters 460, is subsequently provided via the single audio channel 432 as input to one or more dynamic monaural filters 470. The monaural dynamic filters may be any of the monaural dynamic filters described with respect to FIG. 3. The monaural dynamic filters 470 receive an input audio signal via the single audio channel 432 and provide processed output audio signals via the single audio channel 432. In some embodiments with more than one monaural dynamic filter 470, the filters may be connected in series via the single audio channel 432.

An input audio signal, possibly processed by the monaural static filters 460 and the monaural dynamic filters 470, is subsequently provided as input to one or more dynamic binaural filters 480. The binaural dynamic filters 480 may be any of the binaural dynamic filters described with respect to FIG. 3. The binaural dynamic filters 480 receive an input audio signal at each of multiple audio channels 434 (e.g., a left audio channel and a right audio channel). In some embodiments, the output audio signal received from the monaural filters (e.g., one or more of the static filters 460 and/or the dynamic monaural filters 470) via the single audio channel 432 is split and provided as input to the dynamic binaural filters 480 via the multiple audio channels 434. Multiple audio signals are generated as output by the dynamic binaural filters 480 at the multiple audio channels.

Input audio signals at multiple channels are processed to enforce a delay 490 between the channels, as described with respect to FIG. 3.

Subsequent to processing the input audio signal received at the single channel 432, the audio renderer 400 generates spatialized audio content via multiple audio channels, such as a depicted left channel 436 and a right channel 438. While FIG. 4 depicts the flow of an input mono audio signal via the single audio channel 432 and multiple audio channels 434 in a particular order, other embodiments may use different orders for processing the mono audio channel by the audio renderer 400 to generate the multi-channel spatialized audio content.

Figure 5A:
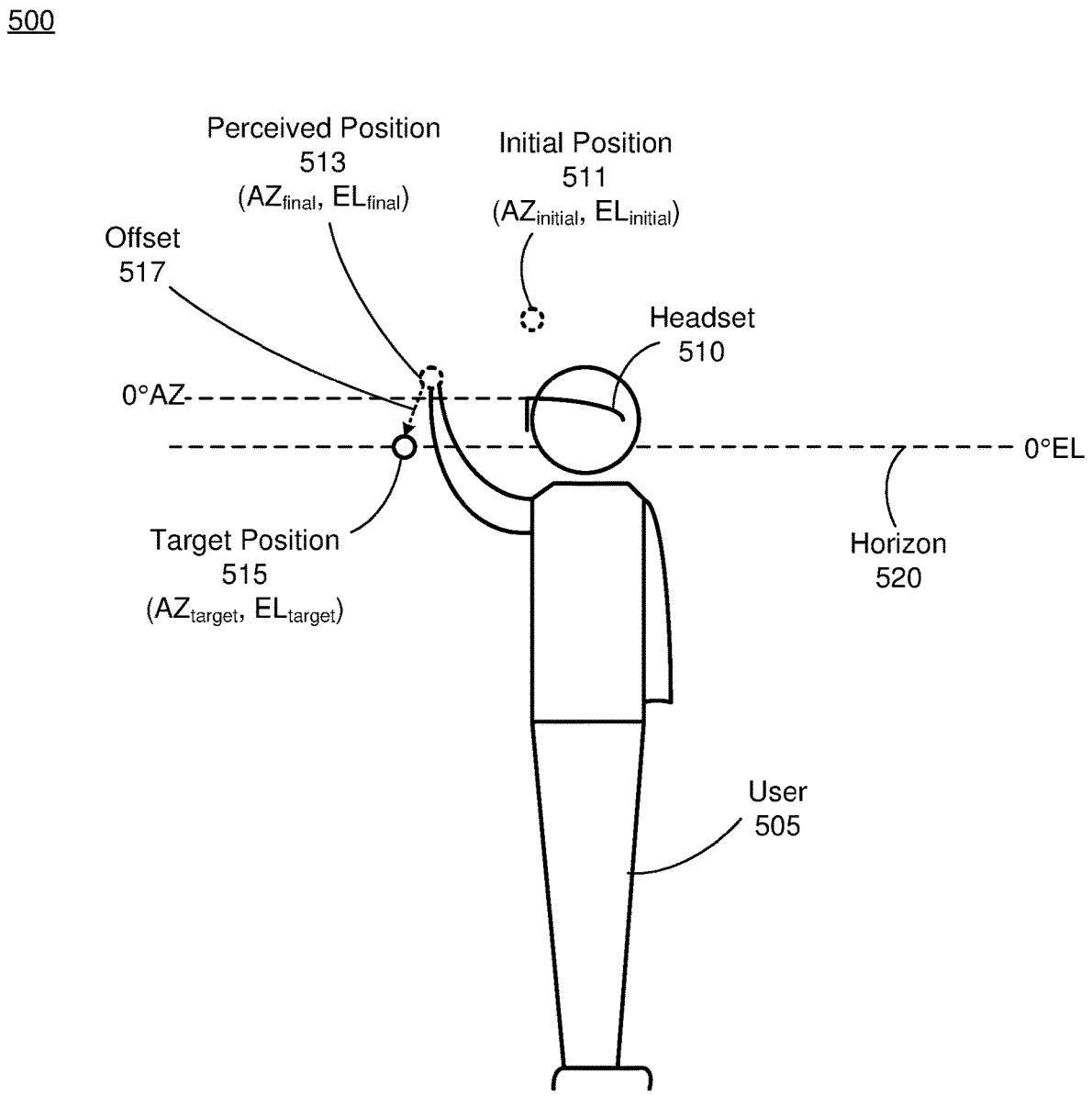
FIG. 5A illustrates an example adjustment of a perceived position of a sound source to match a target position (i.e., intended position) of the sound source based on a feedback from a user of an audio system, in accordance with one or more embodiments.

FIG. 5A illustrates an example adjustment of perceived position of a sound source to match a target position (i.e., intended position) of the sound source based on a feedback (i.e., one or more perceptive responses) from a user 505 of an audio system (e.g., the audio system 200) integrated into a headset 510, in accordance with one or more embodiments. Note that each perceptive response from the user 505 may be provided via an interface device, e.g., an input mechanism of the audio renderer, a smartphone, or some other portable device coupled to the audio system. As discussed in relation to FIG. 4, the input mechanism of the audio renderer may be a dial of the audio renderer, one or more touch sensors of the audio renderer, etc. The audio system may spatialize (e.g., via the audio renderer application module 330 of the audio renderer) the sound source for an initial position 511 of the sound source using an initial version of a HRTF to obtain an initial spatialized sound source for presentation to the user 505. The initial position 511 can be defined by an initial azimuth value $AZ_{initial}$ and an initial elevation value $EL_{initial}$ relative to a horizon 520. The audio renderer (e.g., the audio renderer 400) approximates one or more HRTFs for the user 505, and the approximation is based on values of parameters used by the audio renderer. The audio system may present (e.g., via the audio renderer application module 330) the initial spatialized sound source to the user 505, e.g., using initial values of the parameters of the audio renderer.

The initial version of the HRTF represents a starting point for personalization of the HRTF for the user 505. In one embodiment, the initial version of the HRTF is a universal (e.g., generic or non-individualized) HRTF. In another embodiment, one or more parameters the audio renderer can be predicted (e.g., by the audio renderer selection module 310) that form a predicted HRTF and represents the initial version of the HRTF. In yet another embodiment, the initial version of the HRTF can be selected (e.g., by the audio renderer selection module 320) from a set of HRTFs based on one or more features of the user 505. In such case, the audio renderer selection module 320 may select "the best fit HRTF" from a library of HRTFs (e.g., stored at the data store 235) based on, e.g., anthropometry, one or more photographs, scans, or some other information associated with the user 505. In yet another embodiment, the user 505 can select a HRTF from a library of HRTFs (e.g., stored at the data store 235) as the initial version of the HRTF based on a perceptive response from the user 505 (e.g., when a test sound from the sound source is presented to the user 505 via the audio system).

Upon presenting the initial spatialized sound source to the user 505, the audio system customizes the HRTF for the user 505. The customization of the HRTF is performed in an iterative manner based on at least one perceptive response from the user 505. The customization of the HRTF may be achieved by adjusting (e.g., via the audio renderer configuration module 320) at least one property of the HRTF, in an iterative manner based on at least one perceptive response from the user 505. In some embodiments, the at least one property of the HRTF can be represented by one or more parameters of the audio renderer. Each perceptive response from the user 505 may indicate a respective offset 517 between perceived position 513 of the sound source (e.g., defined by a final azimuth value $AZ_{final}$ and a final elevation value $EL_{final}$ relative to the horizon 520) and a target position 515 of the sound source 505 (e.g., defined by a target azimuth value $AZ_{target}$ and a target elevation value $EL_{target}$ relative to the horizon 520). For the sake of simplicity without losing generality, the target position 515 (i.e., intended position of the sound source) is at the horizon 520, i.e., $EL_{target}=0$). During the iterative HRTF customization process, the offset 517 between the perceived position 513 and the target position 515 is being reduced, e.g., by adjusting values of the one or more parameters of the renderer over a defined time period.

In some embodiments, to reduce the offset 517 and generate the customized HRTF, the audio renderer warps (e.g., via the audio renderer configuration module 320) at least one of an ITD and a spectrum of the HRTF, based on the at least one perceptive response from the user 505. Note that the ITD is associated with perception of an azimuth of the sound source, whereas the spectrum is associated with perception of an elevation of the sound source. In some other embodiments, to reduce the offset 517 and generate the customized HRTF, the audio renderer adjusts (e.g., via the audio renderer configuration module 320) at least one of an amplitude level and a frequency of at least one biquad filter of the audio renderer, based on the at least one perceptive response from the user 505.

In some other embodiments, to reduce the offset 517 and generate the customized HRTF, the audio renderer interpolates (e.g., via the audio renderer configuration module 320) values of a set of parameters of the audio renderer across multiple clusters of parameters, based on the at least one perceptive response from the user 505. In one embodiment, the audio renderer may pan (e.g., via the audio renderer configuration module 320) between centers of at least two clusters to simultaneously adjust the set of parameters of the audio renderer.

In some other embodiments, to reduce the offset 517 and generate the customized HRTF, the audio renderer adjusts (e.g., via the audio renderer configuration module 320) values of a set of parameters of the audio renderer using a machine learning (ML) model, based on the at least one perceptive response from the user 505. In one embodiment, the audio renderer may apply (e.g., via the audio renderer configuration module 320) a nonlinear statistical model to dynamically adjust the set of parameters of the audio renderer.

In some embodiments, the offset 517 can be reduced in an iterative manner based on one or more explicit perceptive responses from the user 505. In one or more embodiments, the user 505 initiates a localization process by pointing to the perceived position 513 of the sound source using an input mechanism of the audio renderer or via a portable interface device (e.g., smartphone wirelessly coupled to the audio system). The target position 515 is where the system intends the sound to be. As such, the user 505 would not be able to perceive the target position 515 unless (i) the target position 515 overlaps with the perceived position 513 and/or (ii) there is a visual indicator of where the target position 515 is. As the user 505 points to the perceived position 513, a camera (e.g., a stand-alone camera or an imaging device integrated into the headset 510, not shown in FIG. 5A) may capture a gesture of the user 505 pointing to the perceived position 513. The audio system may determine (e.g., via the audio controller 230) a location where the user 505 is pointing (i.e., the perceived position 513) based on information about the captured gesture obtained from the camera. The audio system may determine (e.g., via the audio controller 230) the offset 517 and correct a HRTF for the offset 517 by adjusting (e.g., via the audio controller 230) at least one property of the HRTF. The audio system may then adjust (e.g., via the audio controller 230) spatialized sound using the adjusted HRTF for presentation to the user 505. The steps of the localization process can be then repeated when the user 505 points to a new perceived position 513 of the sound source. Once the user 505 is satisfied with the adjusted spatialized sound, the iterative localization process is finished and the adjusted HRTF represented a version of the HRTF personalized (i.e., customized) for the user 505.

In an embodiment, the correction of the HRTF for the offset 517 is implemented as an incremental correction. In such case, a pointing finger of the user 505 would appear to continuously point in a direction of the sound source. In another embodiment, the correction of the HRTF for the offset 517 is implemented as an all-at-once correction. In such case, the pointing finger of the user 505 would appear to feature more of a discrete tracking—as the initial position 511 would skip to a corrected position (i.e., the perceived position 513).

In some embodiments, a display of the headset 510 may present visually where the sound source is supposed to be located (i.e., a location of the target position 515). In such embodiments, the user 505 has a visual indication of how far off the spatialized sound is from the intended location (i.e., the target position 515). In such embodiments, the target position 515 moves toward the perceived position 513. The user 505 would point to the perceived position 513, and the audio system would re-map the HRTF parameters for the target position 515 such that the target position 515 would correspond to the perceived position 513 (as the perceived position 513 and the target position 515 overlap).

In some embodiments, to reduce the offset 517 and generate the customized HRTF, the audio renderer fills-in and extrapolates (e.g., via the audio renderer configuration module 320) to one or more intermediate positions based on the one or more perceptive responses from the user 505. In one embodiment, at least one perceived position (i.e., the perceived position 513) of the sound source pointed by the user 505 is outside of a field of view of the user 505. In such case, to reduce the offset 517 and generate the customized HRTF, the audio renderer may employ (e.g., via the audio renderer configuration module 320) an ML model to fill in rear hemifield (i.e., a portion of the local area outside of the field of view of the user 505). In another embodiment, the user 505 can select (e.g., via the input mechanism of the audio renderer or some other portable interface device) a pair of positions in the local area having different elevations to be perceived positions of the sound source. Additionally, the user 505 may rank the selected pair of positions. To reduce the offset 517 and generate the customized HRTF, the audio renderer may adjust (e.g., via the audio renderer configuration module 320) one or more parameters of the audio renderer based on the selected pair of positions with different elevations.

In some embodiments, the offset 517 can be reduced in an iterative manner based on an implicit behavior by the user 505. Once audio signals are presented to the user 505, the user 505 naturally turns head and/or moves their eyes, i.e., the user 505 hearing a new sound at a particular perceived location may orient their eyes and/or their head in response. A velocity, direction and/or smoothness of this orientation behavior by the user 505 can be analyzed and exploited in order to reduce the offset 517 and customize the HRTF for the given user 505.

In one or more embodiments, an input and/or behavior by the user 505 may provide for one global adjustment—simultaneously warping a set of parameters associated with the audio renderer. In an embodiment, to reduce the offset 517 and generate the customized HRTF, the audio renderer may adjust a specific ITD (e.g., via the audio renderer configuration module 320), whereas other ITDs can be interpolated based on the adjusted ITD. In another embodiment, the user 505 adjusts ITD at, e.g., 15° azimuth and at 50° azimuth (e.g., via the input mechanism of the audio renderer, a smartphone or some other portable interface device), and an ITD curve is fitted to both azimuth values. As the user 505 adds another calibration point (e.g., via the input mechanism of the audio renderer), the audio renderer can interpolate and/or extrapolate intermediate values (e.g., via the audio renderer configuration module 320, a smartphone or some other portable interface device). In one or more other embodiments, to reduce the offset 517 and generate the customized HRTF, the audio renderer may perform multiple adjustments at different points in space (e.g., via the audio renderer configuration module 320), with intervening locations interpolated or extrapolated from the adjusted locations, based on an input by the user 505 (e.g., via the input mechanism of the audio renderer, a smartphone or some other portable interface device) and/or a behavior by the user 505 (e.g., based on information about head orientation and/or eye tracking information).

Figure 5B:
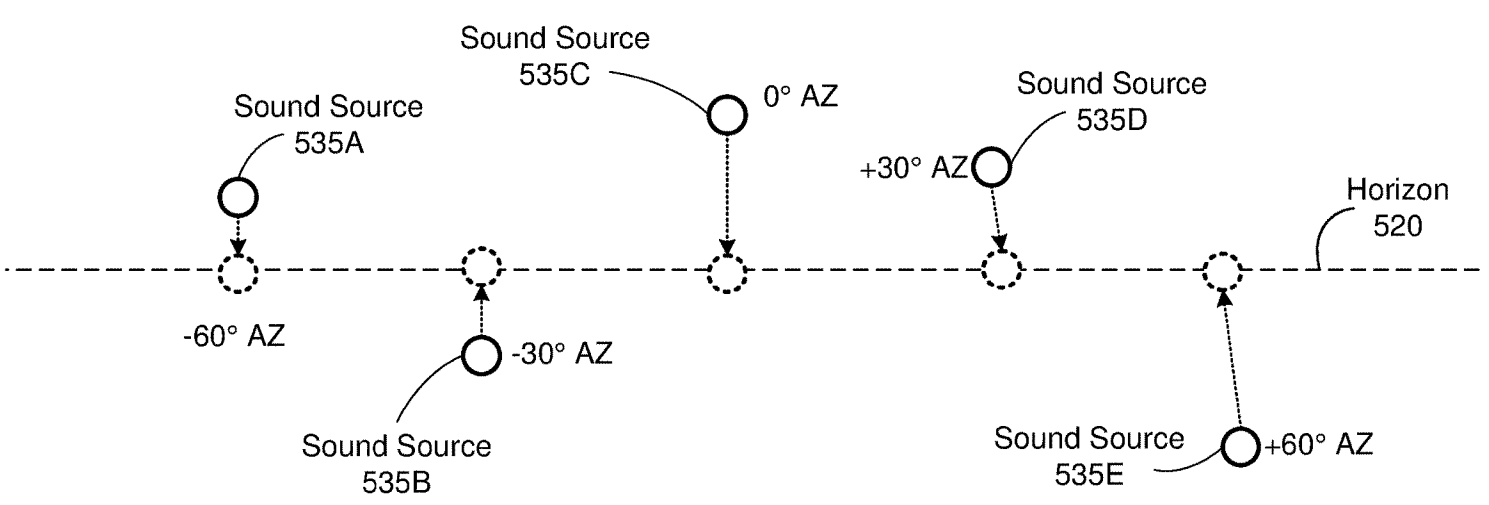
FIG. 5B illustrates an example of discrete numbers of sound source calibrations, in accordance with one or more embodiments.

FIG. 5B illustrates an example of discrete numbers of sound source calibrations, in accordance with one or more embodiments. For the sake of simplicity and without loss of generality, a respective target position of each sound source is located at the horizon 520 and at a respective azimuth value, e.g., −60° (sound source 535A), −30° (sound source 535B), 0° (sound source 535C), +30° (sound source 535D), and +60° (sound source 535E). Also, the sound sources 535A-535E can be presented individually to the user 505. Various types of a feedback (one or more perceptive responses) from the user 505 can be employed for the sound source calibrations to reduce a respective offset between a perceived position and a target position of a respective sound source and to generate a version of the HRTF customized for the user 505. One type of the user's feedback may relate to pointing to a perceived position of the respective sound source (e.g., via the input mechanism of the audio renderer, a smartphone or some other portable interface device). Another type of the user's feedback may relate to positioning an interface device (e.g., a smartphone) toward a perceived position of the respective sound source.

Figure 5C:
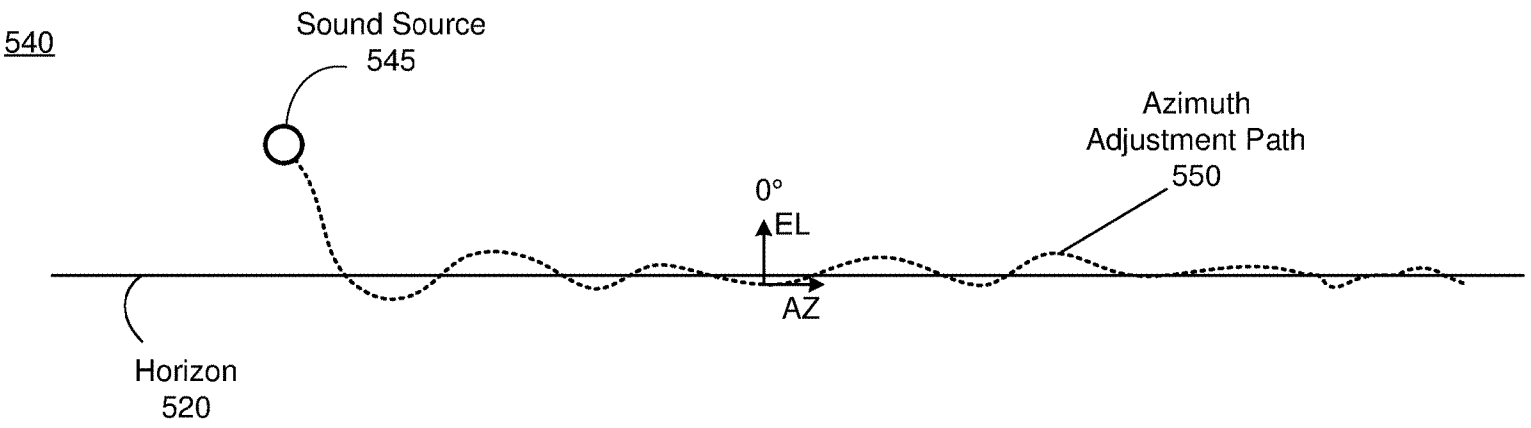
FIG. 5C illustrates an example continuous adjustment of a perceived position of a sound source to match a target position of the sound source, in accordance with one or more embodiments.

FIG. 5C illustrates an example 540 of continuous adjustment of a perceived position of a sound source 545 to match a target position (i.e., intended position) of the sound source 545, in accordance with one or more embodiments. For the sake of simplicity and without loss of generality, the target position of the sound source 545 is at the horizon 520 and at a certain azimuth value that is unknown to the user 505. An azimuth adjustment path 550 in FIG. 5C shows "the pano type" adjustment where the audio system dynamically changes (e.g., via the audio renderer configuration module 320) an azimuth value while the user 505 continuously tunes the perceived position of the sound source 545 (e.g., via the input mechanism of the audio renderer, a smartphone or some other portable interface device) to keep the perceived position of the sound source 545 within a defined elevation threshold from the horizon line 520 as the azimuth value changes.

As the user 505 changes the azimuth value, the audio system updates (e.g., via the audio renderer configuration module 320) the azimuth value of the perceived position and presents sound for the updated azimuth value. Thus, if a pointing finger of the user 505 moves from, e.g. 10° azimuth to 12° azimuth, the audio system would spatialize sound for the 12° azimuth—and the perceived position may change in elevation and/or azimuth. In such case, the user 505 would point at the changed perceived position and the audio system would move the perceived position back toward the target position for that azimuth value. In the case of relatively fast feedback, the adjustment of the perceived position of the sound source 545 would appear to the user 505 as if the sound source 505 is continuously moving towards the horizon 520.

Figure 5D:
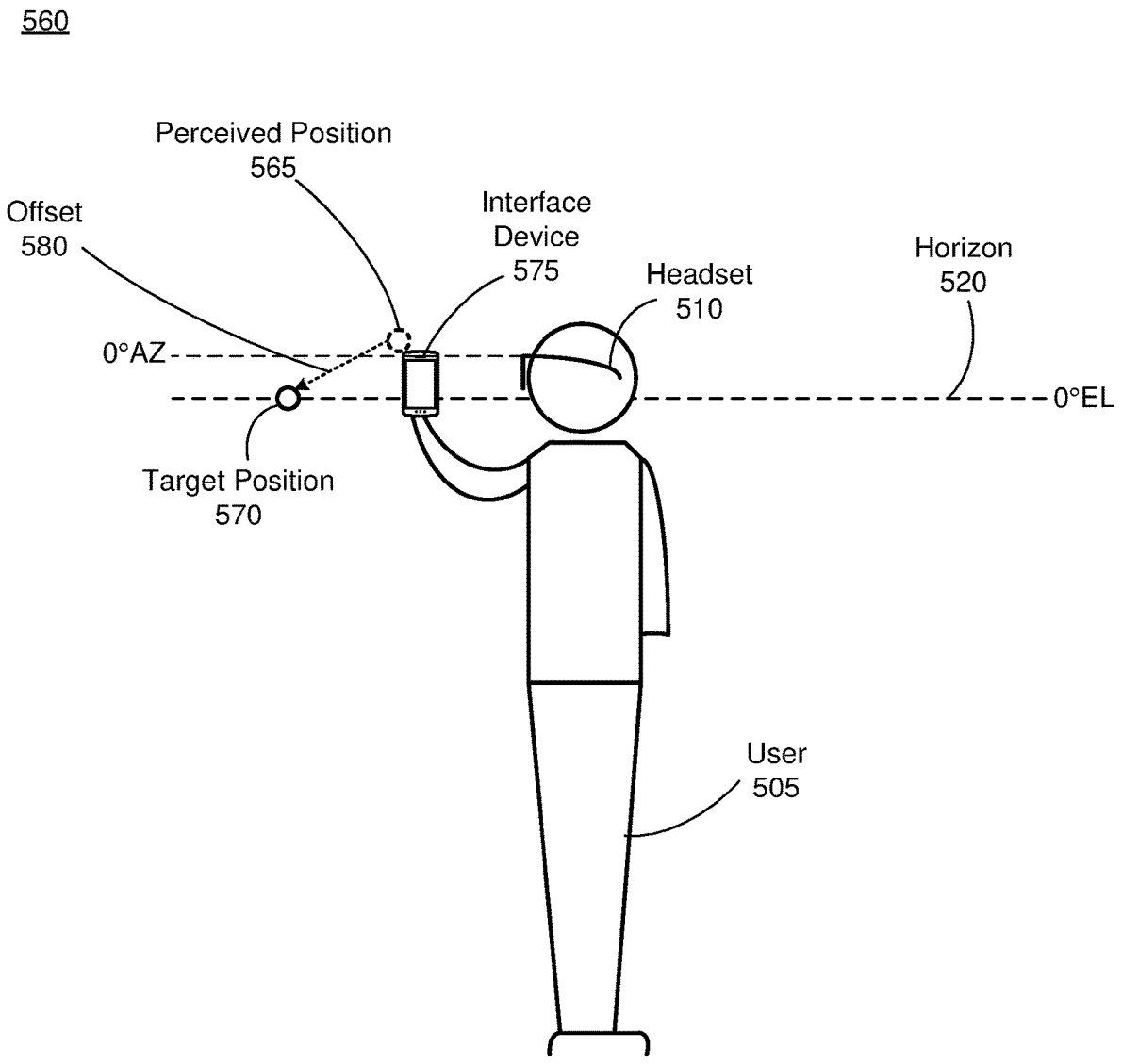
FIG. 5D illustrates an example calibration of a perceived position of a sound source via a device movement, in accordance with one or more embodiments.

FIG. 5D illustrates an example calibration 560 of a perceived position 565 of a sound source to match a target position 570 (i.e., intended position) of the sound source via a movement of an interface device 575, in accordance with one or more embodiments. The user 505 may point, via the interface device 575 (e.g., a smartphone as illustrated in FIG. 5D), to one or more positions in a local area as one or more perceived positions 565 of the sound source. In one embodiment, to reduce an offset 580 between the perceived position 565 and the target position 570 and customize the HRTF, the user 505 may tilt the interface device 575 to adjust, e.g., a time delay curve of the HRTF for correcting ITD to personalize azimuth perception. In another embodiment, to reduce the offset 580 and to customize the HRTF, the user 505 may twist the interface device 575 to adjust an amplitude level and frequency of a particular biquad filter or a set of biquad filters of the audio renderer. Beside the smartphone illustrated in FIG. 5D, the interface device 575 may be an input mechanism of the audio renderer (e.g., a dial, touchscreen, touch sensors, controller, etc.), or some other device capable of receiving inputs from the user 505 that is coupled to the audio system. In one or more embodiments, the user 505 may utilize the input mechanism of the audio renderer to linearly adjusts one or more parameters of the HRTF.

In one or more embodiments, to reduce the offset 580 and customize the HRTF, the audio renderer extrapolates (e.g., via the audio renderer configuration module 320), based on the at least one pointed location, one or more parameters of the audio renderer. The audio system may apply (e.g., via the audio renderer application module 330) the customized HRTF to one or more audio channels to form spatialized audio content for the target position 570. The audio system may present (e.g., via the audio renderer application module 330) the spatialized audio content to the user 505, wherein the offset 580 between the perceived position 565 and the target position 570 is reduced.

Figure 6:
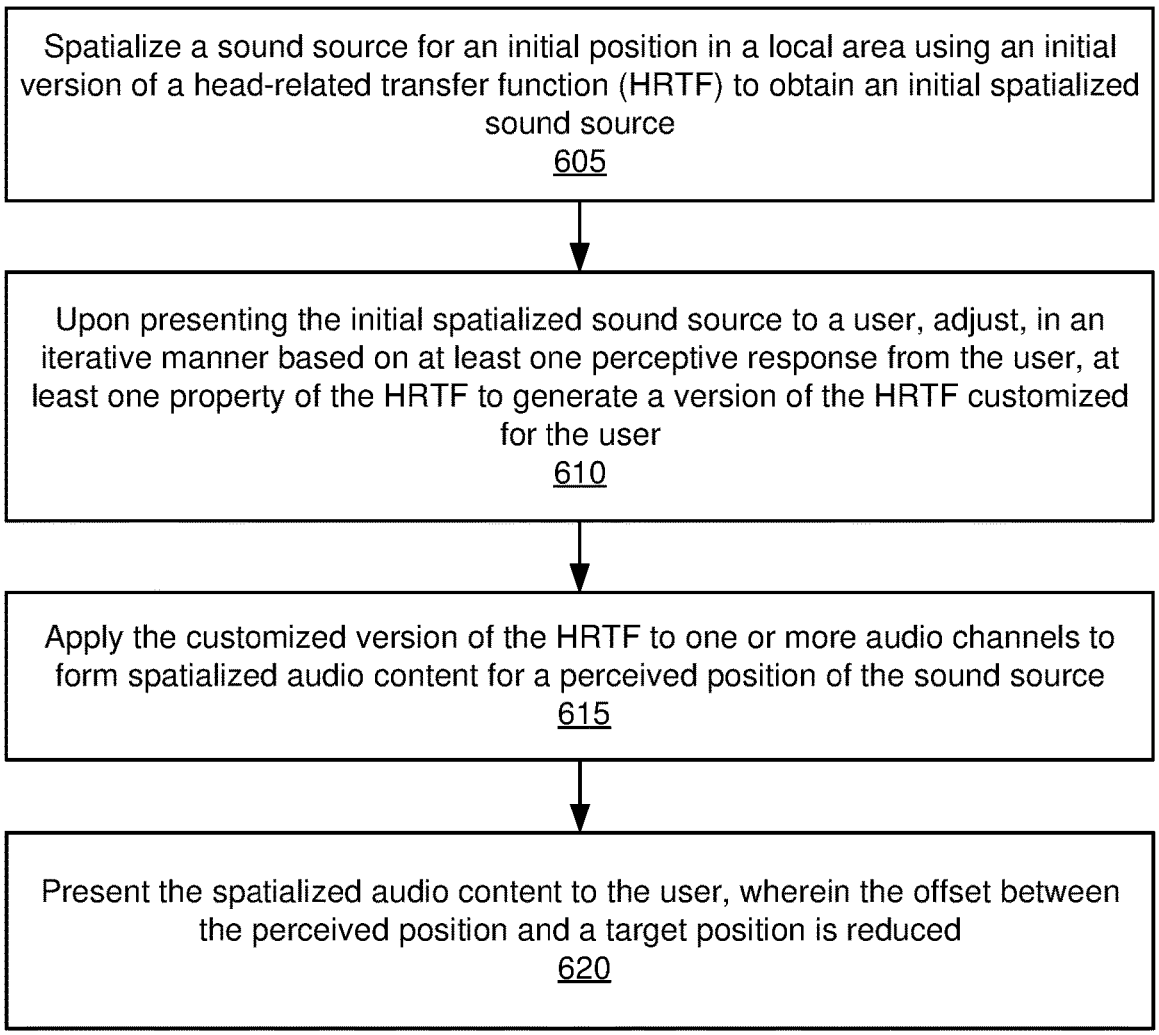
FIG. 6 is a flowchart illustrating a process for personalization of a HRTF, in accordance with one or more embodiments.

FIG. 6 is a flowchart illustrating a process 600 for personalization of a HRTF for a given user, in accordance with one or more embodiments. The process 600 shown in FIG. 6 may be performed by components of an audio system (e.g., components of the sound filter module 300 of the audio system 200) and by the user operating an audio renderer (e.g., the audio renderer 400 in FIG. 4). Other entities may perform some or all of the steps in FIG. 6 in other embodiments. Embodiments may include different and/or additional steps, or perform the steps in different orders.

The audio system spatializes 605 (e.g., via the audio renderer application module 330) a sound source for an initial position in a local area using an initial version of a HRTF to obtain an initial spatialized sound source. In an embodiment, the initial version of the HRTF is a generic HRTF. In another embodiment, the initial version of the HRTF is a non-individualized HRTF. In yet another embodiment, the audio system predicts one or more parameters of the HRTF that form the initial version of the HRTF individualized for the user. In yet another embodiment, the user can select the initial version of the HRTF from a set of HRTFs based on one or more features of the user.

Upon presenting the initial spatialized sound source to a user, the audio system adjusts 610 (e.g., via the audio renderer configuration module 320), in an iterative manner based on at least one perceptive response from the user (e.g., provided via an input mechanism of the audio renderer), at least one property of the HRTF to generate a version of the HRTF customized for the user. Each perceptive response from the user may indicate a respective offset between a perceived position of the sound source and a target position (i.e., intended position) of the sound source upon presentation of at least one spatialized version of the sound source. In one or more embodiments, each perceptive response from the user may also include an indication of a change in an apparent coloration (e.g., spectral profile, equalization, etc.) of a sound originating from the sound source.

In one embodiment, the audio system adjusts (e.g., via the audio renderer configuration module 320) the at least one property of the HRTF by warping at least one of an ITD of the HRTF and a spectrum of the HRTF to generate the customized version of the HRTF, based on the at least one perceptive response from the user. In another embodiment, the audio system adjusts (e.g., via the audio renderer configuration module 320) the at least one property of the HRTF by adjusting at least one of an amplitude level, a frequency and a quality factor of at least one biquad filter associated with the HRTF to generate the customized version of the HRTF, based on the at least one perceptive response from the user. In yet another embodiment, the audio system adjusts (e.g., via the audio renderer configuration module 320) the at least one property of the HRTF by interpolating one or more parameters associated with the HRTF across a plurality of clusters of a plurality of parameters associated with the HRTF to generate the customized version of the HRTF, based on the at least one perceptive response from the user. For example, the audio system may perform (e.g., via the audio renderer configuration module 320) panning between centers of at least two of the clusters to adjust a subset of the parameters during a time period, based on the at least one perceptive response from the user. In yet another embodiment, the audio system adjusts (e.g., via the audio renderer configuration module 320) the at least one property of the HRTF by adjusting one or more parameters associated with the HRTF using a ML model to generate the customized version of the HRTF, based on the at least one perceptive response from the user. In yet another embodiment, the audio system adjusts (e.g., via the audio renderer configuration module 320) the at least one property of the HRTF by dynamically adjusting one or more parameters associated with the HRTF by mapping the one or more parameters to a nonlinear statistical model to generate the customized version of the HRTF, based on the at least one perceptive response from the user.

In one or more embodiments, the audio system adjusts (e.g., via the audio renderer configuration module 320) the at least one property of the HRTF based on pointing, by the user via an interface device (e.g., a smartphone or an input mechanism of the audio renderer), to at least one location in the local area as at least one perceived position of the sound source. The audio system may extrapolate (e.g., via the audio renderer configuration module 320) one or more parameters associated with the HRTF to generate the customized version of the HRTF, based on the at least one pointed location. In one or more other embodiments, the audio system adjusts (e.g., via the audio renderer configuration module 320) the at least one property of the HRTF based on pointing, by the user via an interface device (e.g., a smartphone or an input mechanism of the audio renderer), to at least one location in the local area as at least one perceived position of the sound source, the at least one location being outside of a field of view of the user. The audio system may extrapolate (e.g., via the audio renderer configuration module 320), based on the at least one pointed location and using a machine learning model, one or more parameters associated with the HRTF to generate the customized version of the HRTF. In yet one or more other embodiments, the audio system adjusts (e.g., via the audio renderer configuration module 320) the at least one property of the HRTF based on the user selecting, via an interface device (e.g., a smartphone or an input mechanism of the audio renderer), a pair of elevation indications based on a pair of perceptive responses from the user. The audio system may adjust (e.g., via the audio renderer configuration module 320) one or more parameters associated with the HRTF to generate the customized version of the HRTF, based on the selected pair of elevation indications. In yet one or more other embodiments, the audio system adjusts (e.g., via the audio renderer configuration module 320) the at least one property of the HRTF to generate the customized version of the HRTF based on a movement of at least one of a head of the user and an eye gaze of the user responsive to the presentation of at least one spatialized version of the sound source.

In some embodiments, the audio system adjusts (e.g., via the audio renderer configuration module 320) the at least one property of the HRTF by adjusting at least one ITD of the HRTF based on the at least one perceptive response from the user (e.g., provided via an input mechanism of the audio renderer). The audio system may interpolate (e.g., via the audio renderer configuration module 320) one or more ITDs of the HRTF to generate the customized version of the HRTF, based on the at least one adjusted ITD. In some other embodiments, the audio system adjusts (e.g., via the audio renderer configuration module 320) the initial version of the HRTF to obtain an adjusted version of the HRTF, based on a plurality of perceptive responses from the user (e.g., provided via an input mechanism of the audio renderer when a plurality of audio signals are presented to the user originating from the sound source positioned at a plurality of locations in the local area). The audio system may interpolate (e.g., via the audio renderer configuration module 320), using the adjusted version of the HRTF, one or more parameters associated with the HRTF corresponding to at least one additional location of the sound source in the local area to generate the customized version of the HRTF.

The audio system applies 615 (e.g., via the audio renderer application module 330) the customized version of the HRTF to one or more audio channels to form spatialized audio content for the perceived position. In one or more embodiments, the audio system saves (e.g., at the data store 235) the customized version of the HRTF for further application to the one or more audio channels.

The audio system presents 620 (e.g., via the transducer array 210) the spatialized audio content to the user, wherein the offset between the perceived position and the target position is reduced. In one or more embodiments, the apparent coloration of the spatialized audio content presented to the user is also reduced, e.g., below a threshold level.

In some embodiments, the audio system spatializes the sound source for the initial position using at least one component of an audio renderer (e.g., the audio renderer application module 330). The audio renderer may approximate one or more HRTFs for the user, and the approximation is based on values of parameters used by the audio renderer. The audio system may present (e.g., via the transducer array 210) the initial spatialized sound source using the values of parameters used by the audio renderer. The audio system may adjust, in the iterative manner based on the at least one perceptive response from the user, the values of the parameters to reduce the offset between the perceived position of the sound source and the target position of the sound source. The audio system may spatialize the sound source for the perceived position using the audio renderer configured with the adjusted values of the parameters. The audio system may present the sound source spatialized with the values of parameters adjusted via the audio renderer, wherein the offset between the perceived position and the target position is reduced.

System Environment

Figure 7:
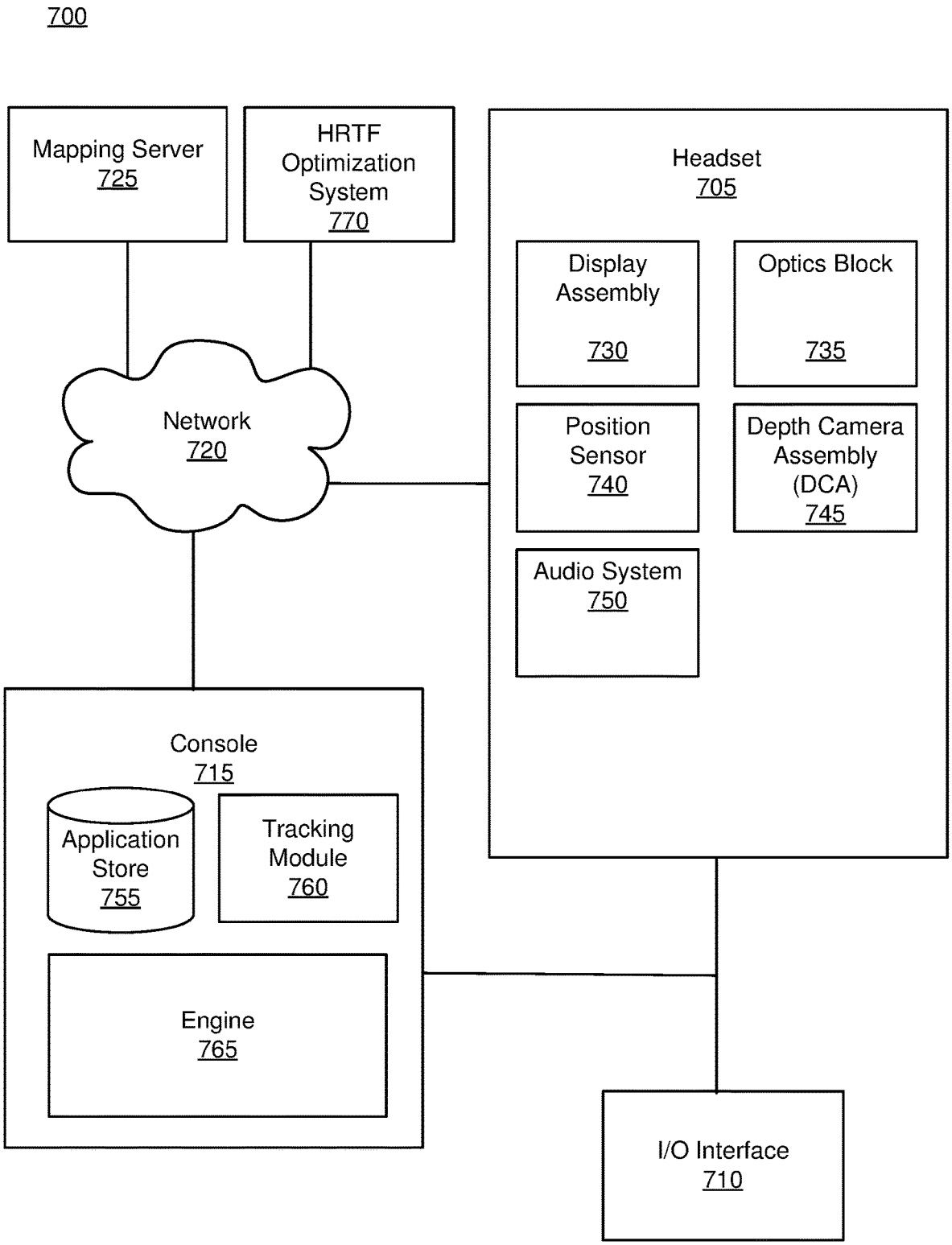
FIG. 7 depicts a block diagram of a system that includes a headset, in accordance with one or more embodiments.

FIG. 7 is a system 700 that includes a headset 705, in accordance with one or more embodiments. In some embodiments, the headset 705 may be the headset 100 of FIG. 1A or the headset 105 of FIG. 1B. The system 700 may operate in an artificial reality environment (e.g., a virtual reality environment, an augmented reality environment, a mixed reality environment, or some combination thereof). The system 700 shown by FIG. 7 includes the headset 705, an input/output (I/O) interface 710 that is coupled to a console 715, the network 720, and the mapping server 725. While FIG. 7 shows an example system 700 including one headset 705 and one I/O interface 710, in other embodiments any number of these components may be included in the system 700. For example, there may be multiple headsets each having an associated I/O interface 710, with each headset and I/O interface 710 communicating with the console 715. In alternative configurations, different and/or additional components may be included in the system 700. Additionally, functionality described in conjunction with one or more of the components shown in FIG. 7 may be distributed among the components in a different manner than described in conjunction with FIG. 7 in some embodiments. For example, some or all of the functionality of the console 715 may be provided by the headset 705.

The headset 705 includes the display assembly 730, an optics block 735, one or more position sensors 740, and the DCA 745. Some embodiments of headset 705 have different components than those described in conjunction with FIG. 7. Additionally, the functionality provided by various components described in conjunction with FIG. 7 may be differently distributed among the components of the headset 705 in other embodiments, or be captured in separate assemblies remote from the headset 705.

The display assembly 730 displays content to the user in accordance with data received from the console 715. The display assembly 730 displays the content using one or more display elements (e.g., the display elements 120). A display element may be, e.g., an electronic display. In various embodiments, the display assembly 730 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 735.

The optics block 735 may magnify image light received from the electronic display, corrects optical errors associated with the image light, and presents the corrected image light to one or both eye boxes of the headset 705. In various embodiments, the optics block 735 includes one or more optical elements. Example optical elements included in the optics block 735 include: an aperture, a Fresnel lens, a convex lens, a concave lens, a filter, a reflecting surface, or any other suitable optical element that affects image light. Moreover, the optics block 735 may include combinations of different optical elements. In some embodiments, one or more of the optical elements in the optics block 735 may have one or more coatings, such as partially reflective or anti-reflective coatings.

Magnification and focusing of the image light by the optics block 735 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110° diagonal), and in some cases, all of the user's field of view. Additionally, in some embodiments, the amount of magnification may be adjusted by adding or removing optical elements.

In some embodiments, the optics block 735 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 735 corrects the distortion when it receives image light from the electronic display generated based on the content.

The position sensor 740 is an electronic device that generates data indicating a position of the headset 705. The position sensor 740 generates one or more measurement signals in response to motion of the headset 705. The position sensor 190 is an embodiment of the position sensor 740. Examples of a position sensor 740 include: one or more IMUs, one or more accelerometers, one or more gyroscopes, one or more magnetometers, another suitable type of sensor that detects motion, or some combination thereof. The position sensor 740 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 705 from the sampled data. For example, the IMU integrates the measurement signals received from the accelerometers over time to estimate a velocity vector and integrates the velocity vector over time to determine an estimated position of a reference point on the headset 705. The reference point is a point that may be used to describe the position of the headset 705. While the reference point may generally be defined as a point in space, however, in practice the reference point is defined as a point within the headset 705.

The DCA 745 generates depth information for a portion of the local area. The DCA includes one or more imaging devices and a DCA controller. The DCA 745 may also include an illuminator. Operation and structure of the DCA 745 is described above in conjunction with FIG. 1A.

The audio system 750 provides audio content to a user of the headset 705. The audio system 750 is substantially the same as the audio system 200 described above. The audio system 750 may comprise one or acoustic sensors, one or more transducers, and an audio controller. The audio system 750 may provide spatialized audio content to the user. In some embodiments, the audio system 750 may request acoustic parameters from the mapping server 725 over the network 720. The acoustic parameters describe one or more acoustic properties (e.g., room impulse response, a reverberation time, a reverberation level, etc.) of the local area. The audio system 750 may provide information describing at least a portion of the local area from e.g., the DCA 745 and/or location information for the headset 705 from the position sensor 740. The audio system 750 may generate one or more sound filters using one or more of the acoustic parameters received from the mapping server 725, and use the sound filters to provide audio content to the user.

In accordance with embodiments of the present disclosure, the audio system 750 facilitates personalization of one or more HRTFs for the user of the headset 705. The audio system 750 may spatialize a sound source for an initial position in a local area using an initial version of the HRTF to obtain an initial spatialized sound source. Upon presenting the initial spatialized sound source to the user, the audio system 750 may adjust, in an iterative manner based on at least one perceptive response from the user, at least one property of the HRTF to generate a version of the HRTF customized for the user. Each perceptive response provided from the user during this iterative customization process may indicate a respective offset between a perceived position of the sound source and a target position of the sound source upon presentation of at least one spatialized version of the sound source. Once the customization process is finished (e.g., the user is satisfied with the presented spatialized version of the sound source), the audio system 750 may apply the customized version of the HRTF to one or more audio channels to form spatialized audio content for the perceived position of the sound source. The audio system 750 presents the generated spatialized audio content to the user, wherein the offset between the perceived position of the sound source and the target position of the sound source is reduced.

The I/O interface 710 is a device that allows a user to send action requests and receive responses from the console 715. An action request is a request to perform a particular action. For example, an action request may be an instruction to start or end capture of image or video data, or an instruction to perform a particular action within an application. The I/O interface 710 may include one or more input devices. Example input devices include: a keyboard, a mouse, a game controller, or any other suitable device for receiving action requests and communicating the action requests to the console 715. An action request received by the I/O interface 710 is communicated to the console 715, which performs an action corresponding to the action request. In some embodiments, the I/O interface 710 includes an IMU that captures calibration data indicating an estimated position of the I/O interface 710 relative to an initial position of the I/O interface 710. In some embodiments, the I/O interface 710 may provide haptic feedback to the user in accordance with instructions received from the console 715. For example, haptic feedback is provided when an action request is received, or the console 715 communicates instructions to the I/O interface 710 causing the I/O interface 710 to generate haptic feedback when the console 715 performs an action.

The console 715 provides content to the headset 705 for processing in accordance with information received from one or more of: the DCA 745, the headset 705, and the I/O interface 710. In the example shown in FIG. 7, the console 715 includes an application store 755, a tracking module 760, and an engine 765. Some embodiments of the console 715 have different modules or components than those described in conjunction with FIG. 7. Similarly, the functions further described below may be distributed among components of the console 715 in a different manner than described in conjunction with FIG. 7. In some embodiments, the functionality discussed herein with respect to the console 715 may be implemented in the headset 705, or a remote system.

The application store 755 stores one or more applications for execution by the console 715. An application is a group of instructions, that when executed by a processor, generates content for presentation to the user. Content generated by an application may be in response to inputs received from the user via movement of the headset 705 or the I/O interface 710. Examples of applications include: gaming applications, conferencing applications, video playback applications, or other suitable applications.

The tracking module 760 tracks movements of the headset 705 or of the I/O interface 710 using information from the DCA 745, the one or more position sensors 740, or some combination thereof. For example, the tracking module 760 determines a position of a reference point of the headset 705 in a mapping of a local area based on information from the headset 705. The tracking module 760 may also determine positions of an object or virtual object. Additionally, in some embodiments, the tracking module 760 may use portions of data indicating a position of the headset 705 from the position sensor 740 as well as representations of the local area from the DCA 745 to predict a future location of the headset 705. The tracking module 760 provides the estimated or predicted future position of the headset 705 or the I/O interface 710 to the engine 765.

The engine 765 executes applications and receives position information, acceleration information, velocity information, predicted future positions, or some combination thereof, of the headset 705 from the tracking module 760. Based on the received information, the engine 765 determines content to provide to the headset 705 for presentation to the user. For example, if the received information indicates that the user has looked to the left, the engine 765 generates content for the headset 705 that mirrors the user's movement in a virtual local area or in a local area augmenting the local area with additional content. Additionally, the engine 765 performs an action within an application executing on the console 715 in response to an action request received from the I/O interface 710 and provides feedback to the user that the action was performed. The provided feedback may be visual or audible feedback via the headset 705 or haptic feedback via the I/O interface 710.

The network 720 couples the headset 705 and/or the console 715 to the mapping server 725. The network 720 may include any combination of local area and/or wide area networks using both wireless and/or wired communication systems. For example, the network 720 may include the Internet, as well as mobile telephone networks. In one embodiment, the network 720 uses standard communications technologies and/or protocols. Hence, the network 720 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 720 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 720 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The mapping server 725 may include a database that stores a virtual model describing a plurality of spaces, wherein one location in the virtual model corresponds to a current configuration of a local area of the headset 705. The mapping server 725 receives, from the headset 705 via the network 720, information describing at least a portion of the local area and/or location information for the local area. The user may adjust privacy settings to allow or prevent the headset 705 from transmitting information to the mapping server 725. The mapping server 725 determines, based on the received information and/or location information, a location in the virtual model that is associated with the local area of the headset 705. The mapping server 725 determines (e.g., retrieves) one or more acoustic parameters associated with the local area, based in part on the determined location in the virtual model and any acoustic parameters associated with the determined location. The mapping server 725 may transmit the location of the local area and any values of acoustic parameters associated with the local area to the headset 705.

The HRTF optimization system 770 for HRTF rendering may utilize neural networks to fit a large database of measured HRTFs obtained from a population of users with parametric filters. The filters are determined in such a way that the filter parameters vary smoothly across space and behave analogously across different users. The fitting method relies on a neural network encoder, a differentiable decoder that utilizes digital signal processing solutions, and performing an optimization of the weights of the neural network encoder using loss functions to generate one or more models of filter parameters that fit across the database of HRTFs. The HRTF optimization system 770 may provide the filter parameter models periodically, or upon request to the audio system 750 for use in generating spatialized audio content for presentation to a user of the headset 705. In some embodiments, the provided filter parameter models are stored in the data store of the audio system 750.

One or more components of system 700 may contain a privacy module that stores one or more privacy settings for user data elements. The user data elements describe the user or the headset 705. For example, the user data elements may describe a physical characteristic of the user, an action performed by the user, a location of the user of the headset 705, a location of the headset 705, HRTFs for the user, etc.

Privacy settings (or "access settings") for a user data element may be stored in any suitable manner, such as, for example, in association with the user data element, in an index on an authorization server, in another suitable manner, or any suitable combination thereof.

A privacy setting for a user data element specifies how the user data element (or particular information associated with the user data element) can be accessed, stored, or otherwise used (e.g., viewed, shared, modified, copied, executed, surfaced, or identified). In some embodiments, the privacy settings for a user data element may specify a "blocked list" of entities that may not access certain information associated with the user data element. The privacy settings associated with the user data element may specify any suitable granularity of permitted access or denial of access. For example, some entities may have permission to see that a specific user data element exists, some entities may have permission to view the content of the specific user data element, and some entities may have permission to modify the specific user data element. The privacy settings may allow the user to allow other entities to access or store user data elements for a finite period of time.

The privacy settings may allow a user to specify one or more geographic locations from which user data elements can be accessed. Access or denial of access to the user data elements may depend on the geographic location of an entity who is attempting to access the user data elements. For example, the user may allow access to a user data element and specify that the user data element is accessible to an entity only while the user is in a particular location. If the user leaves the particular location, the user data element may no longer be accessible to the entity. As another example, the user may specify that a user data element is accessible only to entities within a threshold distance from the user, such as another user of a headset within the same local area as the user. If the user subsequently changes location, the entity with access to the user data element may lose access, while a new group of entities may gain access as they come within the threshold distance of the user.

The system 700 may include one or more authorization/privacy servers for enforcing privacy settings. A request from an entity for a particular user data element may identify the entity associated with the request and the user data element may be sent only to the entity if the authorization server determines that the entity is authorized to access the user data element based on the privacy settings associated with the user data element. If the requesting entity is not authorized to access the user data element, the authorization server may prevent the requested user data element from being retrieved or may prevent the requested user data element from being sent to the entity. Although this disclosure describes enforcing privacy settings in a particular manner, this disclosure contemplates enforcing privacy settings in any suitable manner.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A method comprising:

spatializing a sound source for an initial position in a local area using an initial version of a head-related transfer function (HRTF) to obtain an initial spatialized sound source;

upon presenting the initial spatialized sound source to a user, adjusting, in an iterative manner based on at least one perceptive response from the user, at least one property of the HRTF to generate a version of the HRTF customized for the user, each perceptive response from the user indicating a respective offset between a perceived position and a target position of the sound source upon presentation of at least one spatialized version of the sound source, wherein adjusting the at least one property of the HRTF comprises:

pointing, by the user via an interface device, to at least one location in the local area as at least one perceived location of the sound source, the at least one location being outside of a field of view of the user, and extrapolating, based on the at least one pointed location and using a machine learning (ML) model, one or more parameters associated with the HRTF to generate the customized version of the HRTF;

applying the customized version of the HRTF to one or more audio channels to form spatialized audio content for the perceived position; and presenting the spatialized audio content to the user, wherein the offset between the perceived position and the target position is reduced.

2. The method of claim 1, further comprising:

spatializing the sound source for the initial position using an audio renderer, the audio renderer approximating head-related transfer functions (HRTFs) for the user, and the approximation is based on values of a plurality of parameters used by the audio renderer;

presenting the initial spatialized sound source using the values of the plurality of parameters;

adjusting, in the iterative manner based on the at least one perceptive response from the user, the values of the plurality of parameters to reduce the offset;

spatializing the sound source for the perceived position using the audio renderer configured with the adjusted values of the plurality of parameters; and presenting the sound source spatialized with the adjusted values, wherein the offset between the perceived position and the target position is reduced.

3. The method of claim 1, wherein the initial version of the HRTF is a generic HRTF or a non-individualized HRTF.

4. The method of claim 1, further comprising:

predicting at least one parameter of the HRTF that forms the initial version of the HRTF individualized for the user.

5. The method of claim 1, further comprising:

selecting the initial version of the HRTF from a set of HRTFs based on one or more features of the user.

6. The method of claim 1, wherein each perceptive response from the user further indicates a change in an apparent coloration of a sound from the sound source, and the method further comprising:

presenting the spatialized audio content to the user, wherein the apparent coloration in the presented spatialized audio content is reduced below a threshold level.

7. The method of claim 1, wherein adjusting the at least one property of the HRTF further comprises:

warping at least one of an interaural time difference (ITD) of the HRTF and a spectrum of the HRTF to generate the customized version of the HRTF, based on the at least one perceptive response from the user.

8. The method of claim 1, wherein adjusting the at least one property of the HRTF further comprises:

adjusting at least one of an amplitude level, a frequency, and a quality factor of at least one biquad filter associated with the HRTF to generate the customized version of the HRTF, based on the at least one perceptive response from the user.

9. The method of claim 1, wherein adjusting the at least one property of the HRTF further comprises:

interpolating at least one parameter associated with the HRTF across a plurality of clusters of a plurality of parameters associated with the HRTF to generate the customized version of the HRTF, based on the at least one perceptive response from the user.

10. The method of claim 1, wherein adjusting the at least one property of the HRTF further comprises:

adjusting the one or more parameters associated with the HRTF using the ML model to generate the customized version of the HRTF, based on the at least one perceptive response from the user.

11. The method of claim 1, wherein adjusting the at least one property of the HRTF further comprises:

dynamically adjusting at least one parameter associated with the HRTF by mapping the at least one parameter to a nonlinear statistical model to generate the customized version of the HRTF, based on the at least one perceptive response from the user.

12. The method of claim 1, wherein adjusting the at least one property of the HRTF further comprises:

selecting, by the user via the interface device, a pair of elevation indications based on a pair of perceptive responses from the user; and adjusting at least one parameter associated with the HRTF to generate the customized version of the HRTF, based on the selected pair of elevation indications.

13. The method of claim 1, further comprising:

adjusting the at least one property of the HRTF to generate the customized version of the HRTF, further based on a movement of at least one of a head of the user and an eye gaze of the user responsive to the presentation of at least one spatialized version of the sound source.

14. The method of claim 1, wherein adjusting the at least one property of the HRTF further comprises:

adjusting at least one interaural time difference (ITD) of the HRTF based on the at least one perceptive response from the user; and interpolating one or more ITDs of the HRTF to generate the customized version of the HRTF, based on the at least one adjusted ITD.

15. The method of claim 1, further comprising:

adjusting the initial version of the HRTF to obtain an adjusted version of the HRTF, based on a plurality of perceptive responses from the user when a plurality of audio signals are presented to the user originating from the sound source positioned at a plurality of locations in the local area; and interpolating, using the adjusted version of the HRTF, at least one parameter associated with the HRTF corresponding to at least one additional location of the sound source in the local area to generate the customized version of the HRTF.

16. A non-transitory computer-readable storage medium having instructions encoded thereon that, when executed by a processor, cause the processor to:

spatialize a sound source for an initial position in a local area using an initial version of a head-related transfer function (HRTF) to obtain an initial spatialized sound source;

upon presenting the initial spatialized sound source to a user, adjust, in an iterative manner based on at least one perceptive response from the user, at least one property of the HRTF to generate a version of the HRTF customized for the user, each perceptive response from the user indicating a respective offset between a perceived position and a target position of the sound source upon presentation of at least one spatialized version of the sound source, wherein adjusting the at least one property of the HRTF comprises:

pointing, by the user via an interface device, to at least one location in the local area as at least one perceived location of the sound source, the at least one location being outside of a field of view of the user, and extrapolating, based on the at least one pointed location and using a machine learning model, one or more parameters associated with the HRTF to generate the customized version of the HRTF;

apply the customized version of the HRTF to one or more audio channels to form spatialized audio content for the perceived position; and present the spatialized audio content to the user, wherein the offset between the perceived position and the target position is reduced.

17. The non-transitory computer-readable storage medium of claim 16, wherein the instructions further cause the processor to:

spatialize the sound source for the initial position using an audio renderer, the audio renderer approximating head-related transfer functions (HRTFs) for the user, and the approximation is based on values of a plurality of parameters used by the audio renderer;

present the initial spatialized sound source using the values of the plurality of parameters;

adjust, in the iterative manner based on the at least one perceptive response from the user, the values of the plurality of parameters to reduce the offset;

spatialize the sound source for the perceived position using the audio renderer configured with the adjusted values of the plurality of parameters; and present the sound source spatialized with the adjusted values, wherein the offset between the perceived position and the target position is reduced.

18. An audio system comprising:

an audio controller configured to:

spatialize a sound source for an initial position in a local area using an initial version of a head-related transfer function (HRTF) to obtain an initial spatialized sound source, upon presenting the initial spatialized sound source to a user, adjust, in an iterative manner based on at least one perceptive response from the user, at least one property of the HRTF to generate a version of the HRTF customized for the user, each perceptive response from the user indicating a respective offset between a perceived position and a target position of the sound source upon presentation of at least one spatialized version of the sound source, wherein adjusting the at least one property of the HRTF comprises:

pointing, by the user via an interface device, to at least one location in the local area as at least one perceived location of the sound source, the at least one location being outside of a field of view of the user, and extrapolating, based on the at least one pointed location and using a machine learning model, one or more parameters associated with the HRTF to generate the customized version of the HRTF, and apply the customized version of the HRTF to one or more audio channels to form spatialized audio content for the perceived position; and a transducer array coupled to the audio controller, the transducer array configured to present the spatialized audio content to the user, wherein the offset between the perceived position and the target position is reduced.

* * * * *